US012188226B2

(12) United States Patent
Boucké

(10) Patent No.: US 12,188,226 B2
(45) **Date of Patent: *Jan. 7, 2025**

(54) WALL PANEL FOR FORMING A WALL COVERING WITH MULTIPLE PANELS

(71) Applicant: I4F Licensing NV, Turnhout (BE)

(72) Inventor: Eddy Alberic Boucké, Turnhout (BE)

(73) Assignee: i4F Licensing NV, Turnhout (BE)

( * ) Notice: Subject to any disclaimer, the term of this patent is extended or adjusted under 35 U.S.C. 154(b) by 0 days.

This patent is subject to a terminal disclaimer.

(21) Appl. No.: 18/487,318

(22) Filed: Oct. 16, 2023

(65) Prior Publication Data

US 2024/0035274 A1 Feb. 1, 2024

Related U.S. Application Data

(63) Continuation of application No. 17/719,126, filed on Apr. 12, 2022, now Pat. No. 11,814,838.

(30) Foreign Application Priority Data

Jul. 2, 2021 (NL) ..... 2028616
Jul. 9, 2021 (NL) ..... 2028675

(51) Int. Cl.
*E04B 2/02* (2006.01)

(52) U.S. Cl.
CPC ..... *E04B 2/02* (2013.01); *E04B 2002/0204* (2013.01)

(58) Field of Classification Search
CPC ..... E04B 2/02; E04B 2002/0204; E04F 2201/0153; E04F 2201/023; E04F 2201/043; E04F 2290/045; E04F 13/0833; E04F 13/0866; E04F 13/14; E04F 13/16; E04F 13/18; E04F 13/0894
See application file for complete search history.

(56) References Cited

U.S. PATENT DOCUMENTS

| | | | | |
|---|---|---|---|---|
| 5,024,038 | A | 6/1991 | DePellegrini et al. | |
| 9,903,122 | B2 * | 2/2018 | Naylor | E04F 13/12 |
| 11,060,298 | B2 | 7/2021 | Liu et al. | |
| 11,072,929 | B2 | 7/2021 | De Rick | |

(Continued)

FOREIGN PATENT DOCUMENTS

| | | | |
|---|---|---|---|
| KR | 20030081363 | A | 10/2003 |
| WO | 2019003100 | A1 | 1/2019 |

(Continued)

*Primary Examiner* — Rodney Mintz
(74) *Attorney, Agent, or Firm* — The Webb Law Firm

(57) ABSTRACT

A wall panel for forming a wall covering with multiple panels, including a centrally located core. The core includes a rear side, a decorative side opposite the rear side, and at least two sides including coupling parts for mutual coupling of several panels. The coupling parts are arranged to be coupled with an angling motion. A new panel is arranged to be angled into a panel already forming part of the wall covering. The coupling parts include at least one first coupling part and at least one second coupling part arranged on opposite sides of the core. The first coupling part includes a sideward tongue, an upper bridge portion for connecting the sideward tongue to the core and a downward groove, for accommodating at least a parts of an upward locking element. The second coupling part includes a groove.

15 Claims, 9 Drawing Sheets

(56) References Cited

U.S. PATENT DOCUMENTS

| | | | | |
|---|---|---|---|---|
| 11,124,973 | B2 | 9/2021 | Clement | |
| 11,371,247 | B2 * | 6/2022 | Fahle | E04F 13/0826 |
| 11,702,848 | B2 * | 7/2023 | Boucké | E04F 13/0894 52/588.1 |
| 11,814,838 | B2 * | 11/2023 | Boucké | E04F 13/0866 |
| 2005/0028474 | A1 | 2/2005 | Kim | |
| 2006/0010820 | A1 | 1/2006 | Schwitte et al. | |
| 2016/0312461 | A1 | 10/2016 | Naylor et al. | |
| 2020/0018076 | A1 | 1/2020 | Fahle | |
| 2020/0131780 | A1 * | 4/2020 | De Rick | E04F 13/0846 |
| 2020/0131783 | A1 * | 4/2020 | Liu | B32B 27/18 |
| 2020/0263438 | A1 * | 8/2020 | Clement | B32B 13/12 |
| 2021/0404189 | A1 | 12/2021 | Boucke | |
| 2023/0003015 | A1 * | 1/2023 | Boucké | E04F 13/0894 |

FOREIGN PATENT DOCUMENTS

| | | | |
|---|---|---|---|
| WO | 2019015346 | A1 | 1/2019 |
| WO | 2019064201 | A1 | 4/2019 |
| WO | 2020083615 | A1 | 4/2020 |

* cited by examiner

WALL PANEL FOR FORMING A WALL COVERING WITH MULTIPLE PANELS

CROSS-REFERENCE TO RELATED APPLICATIONS

This application is a continuation application of U.S. patent application Ser. No. 17/719,126, filed Apr. 12, 2022, which claims priority to The Netherlands Patent Application Nos. 2028616 filed Jul. 2, 2021, and U.S. Pat. No. 2,028,675 filed Jul. 9, 2021, the disclosures of which are hereby incorporated by reference in their entirety.

BACKGROUND OF THE INVENTION

Field of the Invention

The present invention relates to a wall panel for forming a wall covering with multiple panels, a wall covering formed of interconnected panels and a method of installing a wall covering.

Description of Related Art

In the last decades many improvements are observed in the world of modular flooring, wherein multiple floor panels can be interconnected in a manner which allows do-it-yourselves installation of high quality flooring products. The present invention aims to bring similar easy to install technology to the world of wall panelling and wall coverings as well.

Although wall panels and floor panels might appear similar at first glance, they each have their own advantages and challenges. For example floor panels (which are typically laid horizontally) are typically provided on a level subfloor, wherein gravity helps to keep the floor panels on the subfloor, whereas wall panels (which are typically placed vertically) do not have that benefit.

SUMMARY OF THE INVENTION

To that end the present invention provides a wall panel according to claim 1, which proposes a wall panel for forming a wall covering with multiple panels, comprising a centrally located core, wherein the core comprises a rear side, a decorative side opposite the rear side, and at least two sides comprising coupling parts for mutual coupling of several panels; wherein the coupling parts are arranged to be coupled with an angling motion, wherein a new panel is arranged to be angled into a panel already forming part of the wall covering; wherein the coupling parts comprise at least one first coupling part and at least one second coupling part arranged on opposite sides of the core, wherein the first coupling part comprises a sideward tongue, an upper bridge portion for connecting the sideward tongue to the core and a downward groove, for accommodating at least a part of an upward locking element; and wherein the second coupling part comprises a groove, for accommodating at least a part of a sideward tongue, defined by an upper lip and a lower lip extending from the core, wherein the lower lip is provided with an upward locking element arranged at a distance from the core, which upward locking element has an inside facing the core, an outside facing away from the core and a surface side between the inside and the outside; wherein the upward locking element is provided with a recess, extending at least partially through the upward locking element, which recess is accessible from the surface side of the upward locking element and extends towards an opposite side of the upward locking element. Upward may be the direction towards the decorative side of the panel. The coupling parts are typically milled or profiled in the core, wherein material is removed to form the coupling parts. Where the core is referenced with respect to the coupling parts, the core may be the portion of the panel that is not profiled.

In describing the panels according to the invention the decorative side may also be referred to as the upper or top side, the rear side may also be referred to as the bottom or lower side. Panels are typically assessed with their plane in horizontal fashion, which is usual for instance for floor panels. However, wall panels are typically oriented 90 degrees flipped compared to that.

The sideward tongue and the groove allow for a relative easy coupling of panels, in which the tongue is placed (at least partially) in the groove, typically slightly inclined, and the panel is simply angled in place. Such coupling provides for a very intuitive coupling of panels. The recess in the upward locking element provides for a predetermined location to attach the wall panel to a supporting surface or support structure, such as a wooden frame or drywall. The panel could for instance be attached by screwing a screw through the recess, through the upward locking element and into a supporting structure. Instead of a screw, also nails or other connecting elements, fastening elements or attachment elements might be used.

The recess thus allows the wall panel to be secured in place. The tongue and groove may also provide for additional securing of the wall panels. When the tongue is arranged in the groove, the tongue and groove may be in contact, preventing the panels to disengage. Additionally, or alternatively, the inside of the upward locking element may be arranged to be in contact with the side of the sideward tongue facing towards the core, or the proximal side of the sideward tongue. The inside of the upward locking element and the proximal side of the sideward tongue may provide for a locking in the plane of the panels, whereas the proximal side of the sideward tongue and the groove may provide for a locking perpendicular to the plane of the panels, at least in coupled condition. This way the panels can be mutually secured, as well as be secured to a supporting structure, preventing the wall covering from coming loose from the wall. The inside of the upward locking element may thus comprise a first locking surfaces, and the side of the sideward tongue facing towards the core may comprise a second locking surface, which locking surfaces cooperate to provide locking of the panels in coupled condition. Alternatively or additionally, the side of the sideward tongue facing towards the decorative side may comprise a third locking surface, and the side of the upper lip facing away from the decorative side may comprise a fourth locking surface, which locking surfaces cooperate to provide locking of the panels in coupled condition.

The recess may be provided with bevelled edges, wherein preferably the recess has a substantially truncated cone shape in cross section, widest at the decorative side narrowing towards the rear side, or a substantially trapezoid-shaped cross section. Bevelled edge may provide for a guiding of attachment elements towards the intended position on the upward locking element.

Preferably the recess is centred in the upward locking element, in particular between the inside and the outside of the upward locking element. This way on both sides of the recess an equal amount of upward locking element remains, or is not recessed, which provides structure on both sides of the recess and a more robust panel. The upward locking element typically has an increased thickness compared to other structural features of the locking element. As such it has more body and more material available to house the recess, which results in a stronger construction overall.

The recess may extend maximally halfway the upward locking element. The recess may thus have a bottom side or bottom surface, arranged maximally halfway the upward locking element. By having the recess extend maximally to halfway the thickness of the upward locking element, sufficient material remains below the recess, between the recess and the rear side.

The recess in the upward locking element may be substantially trapezium-shaped. The recess may also be provided with a second recess or depression, preferably in the middle or centre of the recess. The second recess may be used to guide connecting elements like nails or screws to the middle of the recess (and thus in the second recess). The second recess may be at most half the size or width of the recess, preferably about a third of the size or width of the recess.

At least a part the side of the sideward tongue facing away from the core and/or at least a part of the groove between the upper and lower lip may be partially rounded. Particularly during angling in of panels, rounded surfaces or transitions allow for a relative smooth angling motion, which is not hindered by sharp transition in the panel materials.

In coupled condition a space may be present between the side of the sideward tongue facing the rear side and the lower lip, wherein the space tapers from the upward locking element towards the core. Such space between the lower lip and the sideward tongue allows for additional flexibility in coupling of panels, and creates a space for collecting material potentially being shaved off the lower lip or sideward tongue during coupling. The side of the sideward tongue facing the rear side and the lower lip may not be in contact, wherein in coupled condition only a contact is present between the side of the sideward tongue facing towards the core and the inside of the groove. Not having the rear side of the sideward tongue and the lower lip to be in contact further allows for more flexibility and additional production tolerances.

The width of upward locking element may be less compared to the width of the upper bridge portion, such that preferably a space is present between the outside of the upward locking element and the core of another panel in coupled condition. The width is typically the direction in the plane of the panels. A space between the upward locking element and the core increases tolerances in production (while the panels can still be coupled), and allows for a relative easy coupling of panels, without the need to deform the coupling parts during coupling.

The first coupling part may comprise a first upper contact surface, between the decorative side and the sideward tongue and the side of the upper lip facing away from the core may comprise a second upper contact surface, wherein the first and second upper contact surfaces are arranged to be in contact at least partially in coupled condition. The contact surfaces are the surfaces towards the decorative side of the core of the panels in coupled condition that are in contact. The first and/or second contact surfaces may for example comprise an upper locking element, wherein preferably both contact surfaces comprise upper locking elements which are configured to co-operate in coupled state, to provide locking in one or more directions. The upper contact surface may extend over a distance at least 0.1 times the thickness of the panel, preferably at least 0.15 times the thickness. In place, the upper contact surfaces may be the surfaces that work against gravity. A larger surface area can be used to spread the load and prevent peak tension from occurring.

The first and/or second coupling parts may comprise a bevel or grout, arranged at the decorative side of the panel. A bevel is normally represented by a chamfered surfaces, which slopes from the upper contact surfaces towards the decorative surface of the panels. When two coupled panels are both provided with such chamfered surfaces, these surfaces line up and form a V-shaped recess. When the surfaces are not inclined or chamfered, but are mainly square or rectangular, a U-shaped recess may be formed, either by one panel alone or by combination of two panels. In a particular embodiment of the invention only one of the first and second coupling parts is provided with a bevel or chamfered surface. Preferably it is the coupling part that, in position in the wall covering, points upwards. Any moisture, liquid or rain that could be present on the decorative side of the panel is then guided away from the joined surface between two coupled panels.

The core may comprises a thermoplastic material, in particular a foamed or non-foamed thermoplastic material or PVC, polypropylene, polyethylene or polyurethane and/or one or more fillers such as calcium carbonate, or a wooden material, for instance MDF, HDF or a wood-plastic-composite. The core may also comprise a wood-based foam or densified wood.

A particular material of choice for the core may be a thermoplastic filled with at least one filler like calcium carbonate or other mineral filler. The plastic materials suitable for forming the base layer may include polyurethane, polyamide copolymers, polystyrene, polyvinyl chloride (PVC), polypropylene and polyethylene plastics, all of which have good moulding processability. Polyvinyl chloride (PVC) materials are chemically stable, corrosion resistant, and have excellent flame-retardant properties. Preferably, chlorinated PVC (CPVC) and/or chlorinated polyethylene (CPE) and/or another chlorinated thermoplastic material is/are used to further improve the hardness and rigidity of the base layers, and of the panels as such. The plastic material may be free of any plasticizer in order to increase the desired rigidity of the base layer, which is, moreover, also favourable from an environmental point of view. The at least one filler may be selected from the group consisting of: talc, chalk, wood, calcium carbonate, titanium dioxide, calcined clay, porcelain, a(nother) mineral filler, and a(nother) natural filler. The filler may be formed by fibres and/or may be formed by dust-like particles. Here, the expression "dust" is understood as small dust-like particles (powder), like wood dust, cork dust, or non-wood dust, like mineral dust, stone powder, in particular cement.

The core layer may be made of a composite of at least one polymer and at least one non-polymeric material. The composite of the core layer preferably comprises one or more fillers, wherein at least one filler is selected from the group consisting of: talc, chalk, wood, calcium carbonate, titanium dioxide, calcined clay, porcelain, a(nother) mineral filler, and a(nother) natural filler. The filler may be formed by fibres and/or may be formed by dust-like particles. Here, the expression "dust" is understood as small dust-like particles (powder), like wood dust, cork dust, or non-wood dust, like mineral dust, stone powder, in particular cement. The average particle size of the dust is preferably between 14 and 20 micron, more preferably between 16 and 18 micron. The primary role of this kind of filler is to provide the core layer, and the parallelogrammatic/rhombic tile(s) as such, sufficient hardness. This will allow the tiles, including their—commonly relatively vulnerable—pointed vertexes, to realize chevron patterns in a reliable and durable manner. Moreover, this kind of filler will typically also improve the impact strength of the core layer and of the tile(s) as such.

The weight content of this kind of filler in the composite is preferably between 35 and 75%, more preferably between 40 and 48% in case the composite is a foamed composite, and more preferably between 65 and 70% in case the composite is a non-foamed (solid) composite.

The sideward tongue and groove may be arranged to exert a clamping force in coupled condition, to force two coupled panels together. Such clamping force pushes coupled panels together, improving the connection and therefore improving for instance water tightness of water proof properties of the panels.

The groove may comprise a channel, extending from the groove to the rear side of the wall panel. Such groove may be used to drain water or other liquids that might have entered the coupling parts and the groove in particular. In particular when the groove is on the side of the panel that, in place, is pointing upwards, the groove may be the portion of the coupling parts that is arranged the lowest, and is thus naturally prone for collecting liquid, water or other loose material. A channel, extending at the back or rear side of the panels allows such material or liquid to leave the coupling parts.

The panel may be elongated, and be arranged to be placed horizontally to form part of the wall covering, wherein preferably the first and second coupling parts are arranged on the long sides of the panel and/or wherein two other opposing sides of the wall panel are optionally provided with third and fourth coupling parts, preferably arranged to be coupled in the same angling motion as the first and second coupling parts. Such panels may be used to extend from side to side in a room for instance. Such panels may be about 1.5 to 2.5 meters (4.9 to 8.2 feet) wide, in particular about 1.8 meter wide, and any number of them (mutually connected) may be used to span the width of a room or outside of a building.

The panel may also be elongated, and be arranged to be placed vertically to form part of the wall covering, wherein preferably the first and second coupling parts are arranged on the long side of the panel and/or wherein the two other opposing sides of the wall panel are not provided with coupling parts. Such panels may for instance extend from the floor to the ceiling of a room.

The panel may be elongated, wherein the first and second coupling parts are arranged on the long side of the panel and wherein along the long side of the wall panel multiple recesses are present, preferably evenly spaced along the long side. The recesses may be used to connect the panels to a supporting structure or wall. The more recesses, the more options for connecting, which increases the options when installing the panels. Additionally it may provide for more connections between the panels and the supporting structure or wall, which improves the stability or robustness of the wall covering formed.

The other sides compared to the side with the first and second coupling parts, may thus be provided with coupling parts as well. These coupling parts may be the same coupling parts compared to the first and second coupling part, or these coupling parts may be third and fourth coupling parts preferably arranged to be coupled by means of a downward motion which can be the same angular movement used to angle in the first and second coupling parts. Preferably, the third coupling part comprises an upward tongue, at least one upward flank lying at a distance from the upward tongue and an upward groove formed in between the upward tongue and the upward flank, wherein the upward groove is adapted to receive at least a part of a downward tongue of the fourth coupling part of another panel, wherein the side of the upward tongue facing towards the upward flank is the inside of the upward tongue and the side of the upward tongue facing away from the upward flank is the outside of the upward tongue; wherein the fourth coupling part comprises a downward tongue, at least one downward flank lying at a distance from the downward tongue, and a downward groove formed in between the downward tongue and the downward flank, wherein the downward groove is adapted to receive at least a part of the upward tongue of the first coupling part of another panel, wherein the side of the downward tongue facing towards the downward flank is the inside of the downward tongue and the side of the downward tongue facing away from the downward flank is the outside of the downward tongue; wherein the outside of the downward tongue and the upward flank both comprise an upper contact surface near, or at, or adjoining, or towards a top side of the panel, wherein said contact surfaces extend vertically at least partly, and preferably completely, and wherein the upper contact surface of the outside of the downward tongue of said panel is configured to engage the upper contact surface of the upward flank of an adjacent panel, in coupled condition of said panels; wherein adjoining the upper contact surfaces both the downward tongue and the upward flank comprise an inclined contact surface, wherein the inclined contact surface of the downward tongue of said panel is configured to engage the inclined contact surface of the upward flank of an adjacent panel, in coupled condition of said panels, wherein each vertical part of the upper contact surface and each adjoining inclining surface mutually enclose an angle (a) between 100 and 175 degrees; wherein adjoining the inclined contact surface the downward tongue comprises an outer surface, situated below the inclined contact surface of the downward tongue, and wherein adjoining the inclined contact surface the upward flank comprises an inner surface, situated below the inclined contact surface of the upward flank, wherein the outer and inner surface run substantially parallel and extend at least partly in vertical direction; wherein, in coupled condition of adjacent panel, a space is present between at least a part of the outer surface of said panel and at least a part the inner surface of an adjacent panel.

Preferably the panels, or the coupling parts of the panels, are configured such that they exert a certain locking force in coupled condition, forcing the panels towards each other. Such locking force can for instance be achieved by a clamping configuration or by slightly oversizing one coupling part compared to the other. This creates a force in the plane of the floor panel. This locking force preferably pushes the panels towards each other in the main plane of the panels, and thus pushes the upper contact surfaces together, wherein this clamping improves the connection between the panels and preferably creating a watertight seal between the panels.

Adjoining, and typically directly adjoining or directly below, the upper contact surfaces an inclined contact surface is present. At the inclined surfaces the panels are in contact, to create a connection or seal between the panels. The inclination is preferably such that, looking at the downward tongue, the inclined surface extends outwardly and, looking at the upward flank, the inclined surface extends inwardly. The inclination angle makes it such that the downward tongue thus has a protruding portion and the upward flank has a recessed portion, which in coupled condition are in contact and thus provide a locking effect. The inclination also creates a slight labyrinth, which improves the waterproof properties of the connection.

Adjoining, and typically directly adjoining or directly below, the inclined contact surface the downward tongue comprises an outer surface. This outer surface may for instance be the outermost surface of the downward tongue, or the surface of the outer tongue the furthest from the downward flank. Similarly adjoining, and typically directly adjoining or directly below, the inclined contact surface the upward flank comprises an inner surface. Between the inner surface and the outer surface, a space is present. This space aims to prevent that any force exerted on or by the panels results in pushing the panels together anywhere else than at the upper contact surfaces and/or inclined contact surfaces. If the inner and outer surfaces would be in contact, they could prevent the upper contact surfaces to contact, which would be detrimental to the waterproof properties of the connection. At the top, at the upper contact surfaces and the inclined contact surfaces, the aim is thus to create a connection between the panels, whereas below these contact surfaces the aim is to avoid such connection. The upper contact surfaces (in coupled condition) may be in contact to define a plane, or an inner vertical plane.

A portion of the downward tongue may thus extend beyond the inner vertical plane, wherein said portion may be substantially trapezium-shaped or wedge-shaped. Such shape allows that the portion, when under any locking, coupling or other force in the plane of the panels, is wedged into the space provided in the upward flank while also providing a robust portion able to withstand forces, to create a tight connection between the panels. This in turn improves the waterproof properties of the connection between the panels.

The recess in the upward directed locking element may form a recessed groove, extending along one side of the wall panel, preferably the long side of an elongated panel. A groove may be considered as a large number of adjoining recesses, together forming a preferably continuous groove. Such groove provides for infinite options for attaching elements, at whatever location along the panel.

The lower lip may extend beyond the upper lip along a distance which distance is at least 2 times, preferably at least 3 times, more preferably about 4 times, the thickness of the wall panel. This way a relatively long lower lip is provides, compared to a relatively thin panel. Wall panels according to the invention may for instance mostly be used to cover existing walls, and may not be structural or load bearing components. Such panels can be made relatively thin, which saves material and simplifies placement of these panels. Additionally the extending portion provides for a guide surface during installation. The thickness of the upward locking element may be about half the thickness of the wall panel. The upper side (or the side facing the decorative side of the panel) may thus be arranged about halfway in terms of thickness, which creates a balanced thickness variation along the coupling part profile, preventing formation of too many weak area's in the coupling part.

The distal end of the upper lip may define a joint vertical plane, wherein the lower lip extends beyond said joint vertical plane. In coupled condition, preferably, the distal end of the upper lip and an upper contact surface of the sideward tongue are in contact. In contact, the sideward tongue may extend beyond the joint vertical plane, or extend beyond the upper contact surface of the sideward tongue, less than half the thickness of the panel. Or, in contact, the sideward tongue may extend beyond the joint vertical plane, or extend beyond the upper contact surface of the sideward tongue.

In coupled condition of two panels, a space may be present between the upper bridge portion of a first panel and the upward locking element of a second panel, at least over the complete width of the upward directed locking element, wherein the space preferably continues between the distal end of the upward directed locking element of the second panel and the core of the first panel. A space between the upper bridge portion and the upward locking element serves multiple purposes. It firstly allows for milling or profiling tolerances, such that panels can be mutually coupled even if the profiling is not perfect. Secondly such space can be used to collect loose particles, such as core material particles released from the panels during coupling. Thirdly it provides for an additional space, on top of the recess, to accommodate an attachment element, like a screw or nail, that could potentially partially stick out of the recess after connection.

The upward locking element, at a rear side opposite the surface side, may comprise an adhesive layer, such as a peel of adhesive, for temporarily attaching the wall panel to a supporting surface. By temporarily fixing the wall panel in place, during installation, the installer has free hands for installing the wall panel, without having to worry that the panel falls off.

The adhesive layer may impart adhesive properties sufficient to allow the panel to be releasably attached to a suitable support surface. The adhesive properties of the adhesive of the adhesive layer apply at room temperature (20° C. or 68° F.), or at least at a temperature range of 15 to 25° C. (59 to 77° F.). As such, the adhesive properties apply to the most common temperature in which the panel is intended to be used. For broader applications, it is advantageous when the adhesive properties apply at a temperature range of 0° C. up to 50° C. (32 to 122° F.).

The adhesive layer may be a continuous or discontinuous layer. The adhesive layer may be formed by a plurality of interconnected and/or distant adhesive zones, such as adhesive spots or adhesive strips. It is imaginable that a plurality of adhesive layers is applied. Here, it is imaginable that at least two adhesive layers are applied (parallel) on top of each other and/or are situated in a same plane.

It is advantageous in the panel according to the invention, that the adhesive of the adhesive layer is present on edges and/or corners of the bottom or rear surface of the panel, and preferably on at least 50% of the total bottom surface of the panel. As such, the adhesive of the adhesive layer specifically counteracts the curling at corners and edges of the panel.

In a further preferred embodiment of the panel according to the invention, the adhesive of the adhesive layer is configured to achieve a moderate adhesive strength to a suitable support surface which is lower than 15 MPa, preferably lower than 10 MPa. Such moderate adhesive strength accomplishes that the panel when attached onto a suitable support surface, has an attractive peeling strength which allows an average user to remove a panel from the support surface to which it is attached, with moderate effort. It is advantageous in the panel according to the invention, that the adhesive properties of the bottom surface apply for a period of at least 5 years, preferably at least 10 years.

It is especially preferred in the panel according to the invention, that the adhesive used in the adhesive layer is a pressure sensitive adhesive (PSA), preferably of a detachable type. Pressure sensitive adhesives (PSA) are ready-to-use adhesives and are viscous. In general they are applied as a film to a flexible material. The special feature of these adhesives is that they do not solidify to form a solid material, but remain viscous. As such they have a special place within the group of adhesives that bond via a physical mechanism. For manufacturing pressure sensitive adhesive systems, the adhesives can be dissolved in organic solvents (e.g. natural rubbers, acrylates), can be present as aqueous dispersions (e.g. acrylate dispersions) or can be solvent-free melts (pressure sensitive melts).

The basic formulation of a PSA comprises a base polymer, an adhesive resin and a plasticiser, with optional additives to confer special properties.

The actual adhesion when using pressure sensitive adhesives arises due to intermolecular interactions. Typically, in pressure sensitive adhesives there is still a viscous liquid state in the final bond. As such, the viscosity of the PSA has a direct effect on the adhesive strength. An important distinction can be made in this context between detachable and permanent adhesives.

The group of pressure sensitive adhesives having a lower viscosity, has consequently a low adhesive strength, such that and the adhered object can be detached again after use. These PSA types are tacky and have unlimited open time which means that they can be bonded to another substrate virtually permanently.

Further in the panel according to the invention, it is preferable that the adhesive of the adhesive layer is a warm melt pressure sensitive adhesive and/or a hot melt pressure sensitive adhesive (HMPSA), preferably of a detachable type. Hot melt pressure sensitive adhesives (HMPSA) are a specific type of PSA, and are based on thermoplastic adhesives. Likewise, a HMPSA is characterised by the fact that they do not fully set, and remain permanently sticky. This allows for an excellent adhesive bond even when the glue is cold. The required contact pressure is the key to creating a sufficient coat between the objects to be joined by the HMPSA. A HMPSA retains the ability to form a serviceable bond under light pressure at room temperature. A preferred example of an HMPSA is a polyacrylate based PSA.

With particular preference in the panel according to the invention, the adhesive comprises one or more types of thermoplastic elastomers such as styrenic block copolymers (SBC), ethylene vinyl-acetates (EVA), polyacrylates, and/or amorphous poly-olefins (APO). These highly suitable thermoplastic elastomers can be modified by various types of tackifiers (natural and synthetic resins) in order to attain the specific adhesion performances required. In the context of the invention, the HMPSA preferably comprises one or more types of SBCs. Such a HMPSA is permanently tacky at room temperature and offer good bonding strength under a light finger pressure.

In a preferred embodiment of the panel according to the invention, at least one additional layer is situated in between the core and the adhesive layer. This additional layer may be a backing layer fixedly connected to the bottom side of the core, wherein the applied adhesive layer, preferably PSA layer, is applied onto a bottom side of the backing layer, but wherein said adhesive layer, in particular said PSA layer may also be incorporated within said additional layer.

Here, it is preferred that the backing layer comprises or consists of an elastic layer, which preferably has a foam structure having open and/or closed cells. As such, the elastic properties of the backing layer allows the panel to adapt to any irregularities on the support surface onto which it is applied. Furthermore, the foam structure of the backing layer may further promote the attachment and detachment characteristics of the bottom surface of the panel.

Preferably, the additional layer, in particular backing layer, is at least partially made of nylon 6 (or polycaprolactam), being a semicrystalline polyamide, in particular nylon 6 fibers. More preferably, this layer is a perforated and/or open layer and allows the adhesive layer, during production, to penetrate the additional layer, and which may even allow to use said adhesive layer to glue the perforated and/or open additional layer to the core. A suitable adhesive in this case is e.g. a polyacrylate based PSA. The perforated and/or open layer is typically formed by a woven and/or non-woven layer. Alternatively, the additional layer (or the backing layer), in particular the elastic layer preferably comprises at least one material selected from the group consisting of: ethylene vinyl acetate (EVA), polyurethane (PU), polyethylene (PE), polypropylene (PP), polystyrene (PS), polyvinyl chloride (PVC), rubber, or mixtures thereof. Furthermore, the elastic layer may comprise a filler, in particular, talc, chalk, wood, and/or calcium carbonate.

Typically, the elastic layer has a thickness situated in between 0.1 and 6 mm (0.004 to 0.24 inches). It is conceivable that the elastic backing layer defines (together with the adhesive layer) a lower surface of the panel. In this case it is advantageous in case a plurality of (superficial) suction holes is formed in at least a lower surface of said elastic layer allowing the panel to be quickly attached to a support surface and removed therefrom. Preferably, the elastic backing layer is made from an anisotropic material. Preferably, a plurality of superficial suction holes is formed in at least a lower surface of said elastic layer, wherein the superficial suction holes are open in a direction facing away from the base and substantially closed in a direction facing the base. These superficial suction holes hence define isolated cavities. Typically, the superficial suction holes together define a void footprint (void surface area), wherein material at the lower surface of the elastic layer in between said superficial suction holes define a material footprint (solid surface area). Preferably, the surface area ratio between the void footprint and the material footprint is at least 4, preferably at least 5, more preferably at least 6, thereby allowing the panel to be quickly and relatively firmly attached to a support surface, while easy removal of the panel from said support surface is maintained. A significant advantage of the panel according to the invention is that, due to the quick-release adhesive backing structure, the panel is configured to become quickly attached to a support surface in a stable and durable manner, while the panel can also be detached from said support surface in a quick and easy manner without leaving any residue behind. These properties provide the panel, in particular the panel, good dimensional stabilities, good lay flat characteristics, and a flexibility to easily attach and detach the panel to or from a, preferably non-porous and substantially flat, support surface, such as a floor, wall, or even a ceiling. The lower surface of the elastic layer is not provided with any glue, and is preferably free of glue or other chemical adhesives. The adhesive properties of the lower surface of the elastic layer are caused by the presence of small suction holes (micro-holes, shell-shaped cavities, and/or hemispherical micro-spaces having a suction effect). During installation a panel to be installed is pushed onto a support surface, which will force air to escape from the suction holes, wherein circumferential edges of the suction holes, and/or elastic material of the lower surface situated in between the suction holes, create a substantially air-tight seal between the lower surface of the elastic layer and the support surface. Upon release of the downward force exerted to the panel installed, a vacuum (sub-atmospheric pressure) will be generated within the suction holes, causing the panel to be pulled towards and held against the support surface. Hence, the panels will be significantly less susceptible for curling and will become stabilized with respect to the support surface until the suction force is exceeded by exerting an opposite pulling force to the panel e.g. during de-installation. Since no chemical adhesive (glue) is used, the panel according the invention may be efficiently produced in an in-line production method. The panel according to the invention is preferably a panel, wherein the pile yarns can be made from a number of natural or synthetic fibres. Many types of yarn are made differently though, wherein there are typically two main types of yarn: spun and filament. The yarns may be made of nylon but other suitable synthetic yarns such as polyester, polypropylene, acrylic or blends thereof can be employed. The panel may be either rigid or flexible. It is also conceivable that the base is free of any yarn or fibres.

The elastic layer is designed to exhibit a "stiff-adhere, soft-release"-principle, which can be understood in a simple way as follows. When pulled in a stiff direction, less elastic energy can be stored in the material (much like a stiff spring can store less energy compared to a soft spring), leading to lower energy release rate to drive random crack-like flaws induced by support surface roughness. On the other hand, much more elastic energy can be stored in the material when pulled in the soft direction, especially when the material is strongly anisotropic, leading to much higher energy release rate to drive the support surface roughness induced crack-like flaws.

Preferably, the substantially entire lower surface of the elastic layer is provided with suction holes. This will commonly improve and increase that overall suction effect which can be realized during installation of the panel onto a support surface. Although the size of the suction holes may be uniform, wherein the suction holes may for example be stamped, punched and/or mechanically applied into the lower surface of the elastic layer, it is commonly advantageous that the size of the suction holes varies throughout the entire lower surface of the elastic layer, which allows, for example, that the elastic layer is formed by an elastic foam. The elastic foam may have closed cells (cavities) and/or open cells (cavities). In a foam, typically cells with different sizes are present. In one embodiment, the elastic layer is made from a foam material composed of ethylene vinyl acetate (EVA), which is a copolymer of ethylene and vinyl acetate, rubber, polyurethane (PU), polyethylene (PE), polypropylene (PP), polystyrene (PS), (plasticized) polyvinylchloride (PVC), or mixtures thereof. The elastic layer may optionally include other components, such as a filler, such as chalk, talc, sand, fibre, wood, mineral, and/or carbon; a foaming agent, such as azodicarbonamide, a crosslinking agent, such as dicumyl peroxide, a foaming agent, such as zinc oxide; and/or a colouring agent. Preferably, the elastic layer of the panel according to the present invention provides a rubber foam-like material with regard to softness and flexibility. The material has low-temperature toughness, stress-crack resistance, waterproof properties, air-tight sealing properties, and foam recovery after compression. The backing layer may comprise, for example, a non-woven sheet, a woven sheet, a non-woven polyester sheet, a polypropylene sheet, a glass fibre scrim or tissue sheet or combinations thereof.

The panels according to the invention are for example at least partially made from magnesium oxide, or are magnesium oxide based. The panel according to the invention may comprise: a core provided with an upper side and a lower side, a decorative top structure (or top section) affixed, either directly or indirectly on said upper side of the core, wherein said core comprises: at least one composite layer comprising: at least one magnesium oxide (magnesia) and/or magnesium hydroxide based composition, in particular a magnesia cement. Particles, in particular cellulose and/or silicone based particles, may be dispersed in said magnesia cement. Optionally one or more reinforcement layers, such as glass fibre layers, may be embedded in said composite layer. The core composition may also comprise magnesium chloride leading to a magnesium oxychloride (MOC) cement, and/or magnesium sulphate leading to magnesium oxysulphate (MOS) cement.

It has been found that the application of a magnesium oxide and/or magnesium hydroxide based composition, and in particular a magnesia cement, including MOS and MOC, significantly improves the inflammability (incombustibility) of the decorative panel as such. Moreover, the relatively fireproof panel also has a significantly improved dimensional stability when subject to temperature fluctuations during normal use. Magnesia based cement is cement which is based upon magnesia (magnesium oxide), wherein cement is the reaction product of a chemical reaction wherein magnesium oxide has acted as one of the reactants. In the magnesia cement, magnesia may still be present and/or has undergone chemical reaction wherein another chemical bonding is formed, as will be elucidated below in more detail. Additional advantages of magnesia cement, also compared to other cement types, are presented below. A first additional advantage is that magnesia cement can be manufactured in a relatively energetically efficient, and hence cost efficient, manner. Moreover, magnesia cement has a relatively large compressive and tension strength. Another advantage of magnesia cement is that this cement has a natural affinity for—typically inexpensive—cellulose materials, such as plant fibres wood powder (wood dust) and/or wood chips; This not only improves the binding of the magnesia cement, but also leads a weight saving and more sound insulation (damping). Magnesium oxide when combined with cellulose, and optionally clay, creates magnesia cements that breathes water vapour; this cement does not deteriorate (rot) because this cement expel moisture in an efficient manner. An additional advantage of magnesia cement is that it has a relatively low pH compared to other cement types, which all allows major durability of glass fibre either as dispersed particles in cement matrix and/or (as fiberglass) as reinforcement layer, and, moreover, enables the use other kind of fibres in a durable manner. Moreover, an additional advantage of the decorative panel is that it is suitable both for indoor and outdoor use.

As already addressed, the magnesia cement is based upon magnesium oxide and/or magnesium hydroxide. The magnesia cement as such may be free of magnesium oxide, dependent on the further reactants used to produce the magnesia cement. Here, it is, for example, well imaginable that magnesia as reactant is converted into magnesium hydroxide during the production process of the magnesia cement. Hence, the magnesia cement as such may comprise magnesium hydroxide. Typically, the magnesia cement comprises water, in particular hydrated water. Water is used as normally binder to create a strong and coherent cement matrix.

The magnesia based composition, in particular the magnesia cement, may comprise magnesium chloride ($MgCl_2$). Typically, when magnesia (MgO) is mixed with magnesium chloride in an aqueous solution, a magnesia cement will be formed which comprises magnesium oxychloride (MOC). The bonding phases are $Mg(OH)_2$, $5Mg(OH)_2 \cdot MgCl_2 \cdot 8H_2O$ (5-form), $3Mg(OH)_2 \cdot MgCl_2 \cdot 8H_2O$ (3-form), and $Mg_2(OH)ClCO_3 \cdot 3H_2O$. The 5-form is the preferred phase, since this phase has superior mechanical properties. Related to other cement types, like Portland cement, MOC has superior properties. MOC does not need wet curing, has high fire resistance, low thermal conductivity, good resistance to abrasion. MOC cement can be used with different aggregates (additives) and fibres with good adherence resistance. It also can receive different kinds of surface treatments. MOC develops high compressive strength within 48 hours (e.g. 8,000-10,000 psi). Compressive strength gain occurs early during curing—48-hour strength will be at least 80% of ultimate strength. The compressive strength of MOC is preferably situated in between 40 and 100 N/mm2. The flexural tensile strength is preferably 10-17 N/mm2. The surface hardness of MOC is preferably 50-250 N/mm2. The E-Modulus is preferably 1-3 $10^4$ $N/mm^2$. Flexural strength of MOC is relatively low but can be significantly improved by the addition of fibres, in particular cellulose based fibres. MOC is compatible with a wide variety of plastic fibres, mineral fibres (such as basalt fibres) and organic fibres such as bagasse, wood fibres, and hemp. MOC used in the panel according to the invention may be enriched by one or more of these fibre types. MOC is non-shrinking, abrasion and acceptably wear resistant, impact, indentation and scratch resistant. MOC is resistible to heat and freeze-thaw cycles and does not require air entrainment to improve durability. MOC has, moreover, excellent thermal conductivity, low electrical conductivity, and excellent bonding to a variety of substrates and additives, and has acceptable fire resistance properties. MOC is less preferred in case the panel is to be exposed to relatively extreme weather conditions (temperature and humidity), which affect both setting properties but also the magnesium oxychloride phase development. Over a period of time, atmospheric carbon dioxide will react with magnesium oxychloride to form a surface layer of $Mg_2(OH)ClCO_3 \cdot 3H_2O$. This layer serves to slow the leaching process. Eventually additional leaching results in the formation of hydromagnesite, $4MgO \cdot 3CO_3 \cdot 4H_2O$, which is insoluble and enables the cement to maintain structural integrity.

The magnesium based composition, and in particular the magnesia cement, may be based upon magnesium sulphate, in particular heptahydrate sulphate mineral epsomite ($MgSO_4 \cdot 7H_2O$). This latter salt is also known as Epsom salt. In aqueous solution MgO reacts with MgSO4, which leads to magnesium oxysulfate cement (MOS), which has very good binding properties. In MOS, 5Mg(OH) 2·MgSO4·8H2O is the most commonly found chemical phase. Although MOS is not as strong as MOC, MOS is better suited for fire resistive uses, since MOS start to decompose at temperatures more than two times higher than MOC giving longer fire protection. Moreover, their products of decomposition at elevated temperatures are less noxious (sulfur dioxide) than those of oxychloride (hydrochloric acid) and, in addition, less corrosive. Furthermore, weather conditions (humidity, temperature, and wind) during application are not as critical with MOS as with MOC. The mechanical strength of MOS cement depends mainly on the type and relative content of the crystal phases in the cement. It has been found that four basic magnesium salts that can contribute to the mechanical strength of MOS cement exist in the ternary system $MgO—MgSO_4—H_2O$ at different temperatures between of 30 and 120 degrees Celsius $5Mg(OH)_2 \cdot MgSO_4 \cdot 3H_2O$ (513 phase), $3Mg(OH)_2 \cdot MgSO_4 \cdot 8H_2O$ (318 phase), $Mg(OH)_2 \cdot 2MgSO_4 \cdot 3H_2O$ (123 phase), and $Mg(OH)_2 \cdot MgSO_4 \cdot 5H_2O$ (115 phase). Normally, the 513 phase and 318 phase could only be obtained by curing cement under saturated steam condition when the molar ratio of MgO and MgSO4 was fixed at (approximately) 5:1. It has been found that the 318 phase is significantly contributing to the mechanical strength and is stable at room temperature, and is therefore preferred to be present in the MOS applied. This also applies to the 513 phase. The 513 phase typically has a (micro)structure comprising a needle-like structure. This can be verified by means of SEM analysis. The magnesium oxysulfate ($5Mg(OH)2 \cdot MgSO4 \cdot 3H_2O$) needles may be formed substantially uniform, and will typically have a length of 10-15 μm and a diameter of 0.4-1.0 μm. When it is referred to a needle-like structure, also a flaky-structure and/or a whisker-structure can be meant. In practice, it does not seem feasible to obtain MOS comprising more than 50% 513 or 318 phase, but by adjusting the crystal phase composition can be applied to improve the mechanical strength of MOS. Preferably, the magnesia cement comprises at least 10%, preferably at least 20% and more preferably at least 30% of the $5Mg(OH)_2 \cdot MgSO_4 \cdot 3H_2O$ (513-phase). This preferred embodiment will provide a magnesia cement having sufficient mechanical strength for use in the core layer of a floor panel.

The crystal phase of MOS is adjustable by modifying the MOS by using an organic acid, preferably citric acid and/or by phosphoric acid and/or phosphates. During this modification new MOS phases can obtained, which can be expressed by 5Mg(OH) 2·MgSO4·5H2O (515 phase) and $Mg(OH)_2 \cdot MgSO_4 \cdot 7H_2O$ (517-phase). The 515 phase is obtainable by modification of the MOS by using citric acid. The 517 phase is obtainable by modification of the MOS by using phosphoric acid and/or phosphates ($H_3PO_4$, $KH_2PO_4$, $K_3PO_4$ and $K_2HPO_4$). These 515 phase and 517 phase can be determined by chemical element analysis, wherein SEM analysis proves that the microstructure both of the 515 phase and the 517 phase is a needle-like crystal, being insoluble in water. In particular, the compressive strength and water resistance of MOS can be improved by the additions of citric acid. Hence, it is preferred that MOS, if applied in the panel according to the invention, comprises 5Mg(OH) 2·MgSO4·5H2O (515 phase) and/or $Mg(OH)_2 \cdot MgSO_4 \cdot 7H_2O$ (517-phase). As addressed above, adding phosphoric acid and phosphates can extend the setting time and improve the compressive strength and water resistance of MOS cement by changing the hydration process of MgO and the phase composition. Here, phosphoric acid or phosphates ionize in solution to form $H_2PO_4^-$, $HPO_4^{2-}$, and/or $PO_4^{3-}$, wherein these anions adsorb onto $[Mg(OH)(H_2O)^x]^+$ to inhibit the formation of Mg(OH) 2 and further promote the generation of a new magnesium subsulfate phase, leading to the compact structure, high mechanical strength and good water resistance of MOS cement. The improvement produced by adding phosphoric acid or phosphates to MOS cement follows the order of $H_3PO_4 = KH_2PO + >> K_2HPO_4 >> K_3PO_4$. MOS has better volumetric stability, less shrinkage, better binding properties and lower corrosivity under a significantly wider range of weather conditions than MOC, and could therefore be preferred over MOS. The density of MOS typically varies from 350 to 650 kg/m3. The flexural tensile strength is preferably 1-7 $N/mm^2$.

The magnesium cement composition preferably comprises one or more silicone based additives. Various silicone based additives can be used, including, but not limited to, silicone oils, neutral cure silicones, silanols, silanol fluids, silicone (micro)spheres or silicone particles, and mixtures and derivatives thereof. Silicone oils include liquid polymerized siloxanes with organic side chains, including, but not limited to, poly(methyl)siloxane and derivatives thereof. Neutral cure silicones include silicones that release alcohol or other volatile organic compounds (VOCs) as they cure. Other silicone based additives and/or siloxanes (e.g., siloxane polymers) can also be used, including, but not limited to, hydroxyl (or hydroxy) terminated siloxanes and/or siloxanes terminated with other reactive groups, acrylic siloxanes, urethane siloxanes, epoxy siloxanes, and mixtures and derivatives thereof. As detailed below, one or more crosslinkers (e.g., silicone based crosslinkers) can also be used. The viscosity of the one or more silicone based additives (e.g., silicone oil, neutral cure silicone, silanol fluid, siloxane polymers, etc.) may be about 100 cSt (at which is called low-viscous. In alternative embodiments, the viscosity of the one or more silicone based additives (e.g., silicone oil, neutral cure silicone, silanol fluid, siloxane polymers, etc.) is between about 20 cSt (25° C.) and about 2000 cSt (25° C.). In other embodiments, the viscosity of the one or more silicone based additives (e.g., silicone oil, neutral cure silicone, silanol fluid, siloxane polymers, etc.) is between about 100 cSt (25° C.) and about 1250 cSt (25° C.). In other embodiments, the viscosity of the one or more silicone based additives (e.g., silicone oil, neutral cure silicone, silanol fluid, siloxane polymers, etc.) is between about 250 cSt (25° C.) and 1000 cSt (25° C.). In yet other embodiments, the viscosity of the one or more silicone based additives (e.g., silicone oil, neutral cure silicone, silanol fluid, siloxane polymers, etc.) is between about 400 cSt (25° C.) and 800 cSt (25° C.). And in particular embodiments, the viscosity of the one or more silicone based additives (e.g., silicone oil, neutral cure silicone, silanol fluid, siloxane polymers, etc.) is between about 800 cSt (25° C.) and about 1250 cSt (25° C.). One or more silicone based additives having higher and/or lower viscosities can also be used. For example, in further embodiments, the viscosity of the one or more silicone based additives (e.g., silicone oil, neutral cure silicone, silanol fluid, siloxane polymers, etc.) is between about 20 cSt (25° C.) and about 200,000 (25° C.) cSt, between about 1,000 cSt (25° C.) and about 100,000 cSt (25° C.), or between about 80,000 cSt (25° C.) and about 150,000 cSt (25° C.). In other embodiments, the viscosity of the one or more silicone based additives (e.g., silicone oil, neutral cure silicone, silanol fluid, siloxane polymers, etc.) is between about 1,000 cSt (25° C.) and about 20,000 cSt (25° C.), between about 1,000 cSt (25° C.) and about 10,000 cSt (25° C.), between about 1,000 cSt (25° C.) and about 2,000 cSt (25° C.), or between about 10,000 cSt (25° C.) and about 20,000 cSt (25° C.). In yet other embodiments, the viscosity of the one or more silicone based additives (e.g., silicone oil, neutral cure silicone, silanol fluid, siloxane polymers, etc.) is between about 1,000 cSt (25° C.) and about 80,000 cSt (25° C.), between about 50,000 cSt (25° C.) and about 100,000 cSt (25° C.), or between about 80,000 cSt (25° C.) and about 200,000 cSt (25° C.). And in still further embodiments, the viscosity of the one or more silicone based additives (e.g., silicone oil, neutral cure silicone, silanol fluid, siloxane polymers, etc.) is between about 20 cSt (25° C.) and about 100 cSt (25° C.). Other viscosities can also be used as desired.

In a preferred embodiment, the magnesium cement composition, in particular the magnesium oxychloride cement composition, comprises a single type of silicone based additive. In other embodiments, a mixture of two or more types of silicone based additives are used. For example, in some embodiments, the magnesium oxychloride cement composition can include a mixture of one or more silicone oils and neutral cure silicones. In particular embodiments, the ratio of silicone oil to neutral cure silicone can be between about 1:5 and about 5:1, by weight. In other such embodiments, the ratio of silicone oil to neutral cure silicone can be between about 1:4 and about 4:1, by weight. In other such embodiments, the ratio of silicone oil to neutral cure silicone can be between about 1:3 and about 3:1, by weight. In yet other such embodiments, the ratio of silicone oil to neutral cure silicone can be between about 1:2 and about 2:1, by weight. In further such embodiments, the ratio of silicone oil to neutral cure silicone can be about 1:1, by weight.

It is imaginable that one or more crosslinkers are used in the magnesia cement. In some embodiments, the crosslinkers are silicone based crosslinkers. Exemplary crosslinkers include, but are not limited to, methyllrime hoxysilane, methyltrie hoxysilane, methyltris (methylethylketoximino)silane and mixtures and derivatives thereof. Other crosslinkers (including other silicone based crosslinkers) can also be used. In some embodiments, the magnesium oxychloride cement composition comprises one or more silicone based additives (e.g., one or more silanols and/or silanol fluids) and one or more crosslinkers. The ratio of one or more silicone based additives (e.g., silanols and/or silanol fluids) to crosslinker can be between about 1:20 and about 20:1, by weight, between about 1:10 and about 10:1 by weight, or between about 1:1 and about 10:1, by weight.

The magnesium (oxychloride) cement compositions comprising one or more silicone based additives may exhibit reduced sensitivity to water as compared to traditional magnesium (oxychloride) cement compositions. Further, in some embodiments, the magnesium (oxychloride) cement compositions comprising one or more silicone based additives may exhibit little or no sensitivity to water. The magnesium (oxychloride) cement compositions comprising one or more silicone based additives can further exhibit hydrophobic and water resistant properties.

Also, the magnesium (oxychloride) cement compositions comprising one or more silicone based additives can exhibit improved curing characteristics. For example, magnesium (oxychloride) cement compositions cure to form various reaction products, including $3Mg(OH)_2 \cdot MgCl_2 \cdot 8H2O$ (phase 3) and $5Mg(OH)_2 \cdot MgCl_2 \cdot 8H_2O$ (phase 5) crystalline structures. In some situations, higher percentages of the $5Mg(OH)_2 \cdot MgCl_2 \cdot 8H_2O$ (phase 5) crystalline structure is preferred. In such situations, the addition of one or more silicone based additives to the magnesium oxychloride cement compositions can stabilize the curing process which can increase the percentage yield of $5Mg(OH)_2 \cdot MgCl_2 \cdot 8H_2O$ (phase 5) crystalline structures. For example, in some embodiments, the magnesium oxychloride compositions comprising one or more silicone based additives can cure to form greater than 80% (phase 5) crystalline structures. In other embodiments, the magnesium oxychloride compositions comprising one or more silicone based additives can cure to form greater than 85% $5Mg(OH)_2 \cdot MgCl_2 \cdot 8H_2O$ (phase 5) crystalline structures. In yet other embodiments, the magnesium oxychloride compositions comprising one or more silicone based additives can cure to form greater than 90% $5Mg(OH)2 \cdot MgCl2 \cdot 8H_2O$ (phase 5) crystalline structures. In yet other embodiments, the magnesium oxychloride compositions comprising one or more silicone based additives can cure to form greater than 95% $5Mg(OH)_2 \cdot MgCl_2 \cdot 8H_2O$ (phase 5) crystalline structures. In yet other embodiments, the magnesium oxychloride compositions comprising one or more silicone based additives can cure to form greater than 98% $5Mg(OH)_2 \cdot MgCl_2 \cdot 8H_2O$ (phase 5) crystalline structures. In yet other embodiments, the magnesium oxychloride compositions comprising one or more silicone based additives can cure to form about 100% $5Mg(OH)_2 \cdot MgCl_2 \cdot 8H_2O$ (phase 5) crystalline structures.

Furthermore, the magnesium (oxychloride) cement compositions comprising one or more silicone based additives can also exhibit increased strength and bonding characteristics. If desired, the magnesium (oxychloride) cement compositions comprising one or more silicone based additives can also be used to manufacture magnesium (oxychloride) cement or concrete structures that are relatively thin. For example, the magnesium (oxychloride) cement compositions comprising one or more silicone based additives can be used to manufacture cement or concrete structures or layers having thicknesses of less than 8 mm, preferably less than 6 mm.

For realizing the coupling between the coupling part, temporary deformation of the coupling part(s) may be desired and/or even required, as a result of which it is beneficial to mix magnesium oxide and/or magnesium hydroxide and/or magnesium chloride and/or magnesium sulphate with one or more silicone based additives, since this leads to an increased a degree of flexibility and/or elasticity. For example, in some embodiments, cement and concrete structures formed using the magnesium oxychloride cement compositions can bend or flex without cracking or breaking.

The magnesium (oxychloride) cement compositions comprising one or more silicone based additives can further comprise one or more additional additives. The additional additives can be used to enhance particular characteristics of the composition. For example, in some embodiments, the additional additives can be used to make the structures formed using the disclosed magnesium oxychloride cement compositions look like stone (e.g., granite, marble, sandstone, etc.). In particular embodiments, the additional additives can include one or more pigments or colorants. In other embodiments, the additional additives can include fibers, including, but not limited to, paper fibers, wood fibers, polymeric fibers, organic fibers, and fiberglass. The magnesium oxychloride cement compositions can also form structures that are UV stable, such that the color and/or appearance is not subject to substantial fading from UV light over time. Other additives can also be included in the composition, including, but not limited to plasticizers (e.g., polycarboxylic acid plasticizers, polycarboxylate ether-based plasticizers, etc.), surfactants, water, and mixtures and combinations thereof. As indicated above, the magnesium oxychloride cement composition, if applied, can comprise magnesium oxide (MgO), aqueous magnesium chloride ($MgCl_2$ (aq)), and one or more silicone based additives. Instead of aqueous magnesium chloride ($MgCl_2$) magnesium chloride ($MgCl_2$) powder can also be used. For example, magnesium chloride ($MgCl_2$) powder can be used in combination with an amount of water that would be equivalent or otherwise analogous to the addition of aqueous magnesium chloride ($MgCl_2$ (aq)).

In certain embodiments, the ratio of magnesium oxide (MgO) to aqueous magnesium chloride ($MgCl_2$ (aq)), if applied, in the magnesium oxychloride cement composition can vary. In some of such embodiments, the ratio of magnesium oxide (MgO) to aqueous magnesium chloride ($MgCl_2$ (aq)) is between about 0.3:1 and about 1.2:1, by weight. In other embodiments, the ratio of magnesium oxide (MgO) to aqueous magnesium chloride ($MgCl_2$ (aq)) is between about 0.4:1 and about 1.2:1, by weight. And in yet other embodiments, the ratio of magnesium oxide (MgO) to aqueous magnesium chloride ($MgCl_2$ (aq)) is between about 0.5:1 and about 1.2:1, by weight.

The aqueous magnesium chloride ($MgCl_2$ (aq)) can be described as (or otherwise derived from) a magnesium chloride brine solution. The aqueous magnesium chloride ($MgCl_2$ (aq)) (or magnesium chloride brine) can also include relatively small amounts of other compounds or substances, including but not limited to, magnesium sulphate, magnesium phosphate, hydrochloric acid, phosphoric acid, etcetera.

In a preferred embodiment the amount of the one or more (liquid) silicone based additives within the magnesium oxychloride cement composition can be defined as the ratio of silicone based additives to magnesium oxide (MgO). For example, in some embodiments, the weight ratio of silicone based additives to magnesium oxide (MgO), is between 0.06 and 0.6.

Preferably, it is also imaginable, and even favourable, to incorporate in the core layer at least one oil, such as linseed oil or silicon oil. This renders the magnesium based core layer and/or thermoplastic based core layer more flexibility and reduced risk of breakage. Instead of or in addition to oil it is also imaginable to incorporate in the core layer one or more water-soluble polymers or polycondensed (synthetic) resins, such as polycarboxylic acid. This leads to the advantage that during drying/curing/setting the panel will not shrink which prevents the formation of cracks, and moreover provides the core layer, after drying/curing/setting, a more hydrophobic character, which prevents penetration of water (moisture) during subsequent storage and use.

It is imaginable that the core layer comprises polycaprolactone (PCL). This biodegradable polymer is especially preferred as this has been found to be made to melt by the exothermic reaction of the reaction mixture. It has a melting point of ca. 60° C. The PCL may be low density or high density. The latter is especially preferred as it produces a stronger core layer. Instead of, or in addition to, other polymers may be used, preferably a polymer chosen from the group consisting of: other poly(lactic-co-glycolic acid) (PLGA), poly(lactic acid) (PLA), poly(glycolic acid) (PGA), the family of polyhydroxyalkanoates (PHA), polyethylene glycol (PEG), polypropylene glycol (PPG), polyesteramide (PEA), poly(lactic acid-co-caprolactone), poly (lactide-co-trimethylene carbonate), poly(sebacic acid-co-ricinoleic acid) and a combination thereof.

Alternatively, the panel, in particular the core layer, may at least partly be made of PVC, PET, PP, PS or (thermoplastic) polyurethane (PUR). PS may be in the form of expanded PS (EPS) in order to further reduce the density of the panel, which leads to a saving of costs and facilitates handling of the panels. Preferably, at least a fraction of the polymer used may be formed by recycled thermoplastic, such a recycled PVC or recycled PUR. Recycled PUR may be made based on recyclable polymers, such as based on recyclable PET. PET can be recycled chemically by using glycolysis or depolymerisation of PET into monomers or oligomers, and subsequently into polyurethane polyols. It is also imaginable that rubber and/or elastomeric parts (particles) are dispersed within at least one composite layer to improve the flexibility and/or impact resistance at least to some extent. It is conceivable that a mix of virgin and recycled thermoplastic material is used to compose at least a part of the core. Preferably, in this mix, the virgin thermoplastic material and the recycled thermoplastic material is basically the same. For example, such a mix can be entirely PVC-based or entirely PUR-based. The core may be solid or foamed, or both in case the core is composed of a plurality of parts/layers. The core may also comprise fillers, such as mineral fillers.

It may be advantageous that the core layer comprises porous granules, in particular porous ceramic granules. Preferably the granules have a plurality of micropores of an average diameter of from 1 micron to 10 micron, preferably from 4 to 5 micron. That is, the individual granules preferably have micropores. Preferably, the micropores are interconnecting. They are preferably not confined to the surface of the granules but are found substantially throughout the cross-section of the granules. Preferably, the size of the granules is from 200 micron to 900 micron, preferably 250 micron to 850 micron, especially 250 to 500 micron or 500 to 850 micron. Preferably, at least two different sizes of granules, most preferably two, are used. Preferably, small and/or large granules are used. The small granules may have a size range of 250 to 500 micron. Preferably the large granules have a diameter of 500 micron to 850 micron. The granules may each be substantially of the same size or of two or more predetermined sizes. Alternatively, two or more distinct size ranges may be used with a variety of different sized particles within each range. Preferably two different sizes or ranges of sizes are used. Preferably, the granules each comprise a plurality of microparticles, substantially each microparticle being partially fused to one or more adjacent microparticles to define a lattice defining the micropores. Each microparticle preferably has an average size of 1 micron to 10 micron, with an average of 4 to 5 micron. Preferably, the average size of the micropores is from 2 to 8 micron, most preferably 4 to 6 micron. The micropores may be irregular in shape.

Accordingly, the size of the micropores, and indeed the midi-pores referred to below, are determined by adding the widest diameter of the pore to the narrowest diameter of the pore and dividing by 2. Preferably, the ceramic material is evenly distributed throughout a cross-section of the core layer that is substantially without clumps of ceramic material forming. Preferably, the microparticles have an average size of at least 2 micron or 4 micron and/or less than 10 micron or less than 6 micron, most preferably 5 to 6 micron. This particle size range has been found to allow the controlled formation of the micropores.

The granules may also comprise a plurality of substantially spherical midi-pores having an average diameter of 10 to 100 micron. They substantially increase the total porosity of the ceramic material without compromising the mechanical strength of the materials. The midi-pores are preferably interconnected via a plurality of micropores. That is, the midi-pores may be in fluid connection with each other via micropores. The average porosity of the ceramic material itself is preferably at least 50%, more preferably greater than 60%, most preferably 70 to 75% average porosity. The ceramic material used to produce the granules may be any (non-toxic) ceramic known in the art, such as calcium phosphate and glass ceramics. The ceramic may be a silicate, though is preferably a calcium phosphate, especially [alpha]- or [beta]-tricalcium phosphate or hydroxyapatite, or mixtures thereof. Most preferably, the mixture is hydroxyapatite and [beta]-tricalcium phosphate, especially more than 50 w/w [beta]-tricalcium, most preferably 85% [beta]-tricalcium phosphate and 15% hydroxyapatite. Most preferably the material is 100% hydroxyapatite. Preferably the cement composition or dry premix comprises 15 to 30% by weight of granules of the total dry weight of the composition or premix.

The porous particles could lead to a lower average density of the core layer and hence to a reduction of weight which is favourable from an economic and handling point of view. Moreover, the presence of porous particles in the core layer typically leads to, at least some extent, an increased porosity of a porous top surface and bottom surface of the core layer, which is beneficial for attaching an additional layer to the top surface and/or bottom surface of the core layer, such as, for example, a primer layer, an (initially liquid) adhesive layer, or another decorative or functional layer. Often, these layers are initially applied in a liquid state, wherein the pores allow the liquid substance to be sucked up (to permeate) into the pores, which increases the contact surface area between the layers and hence improves the bonding strength between said layers.

The panels may comprise a layered structure, comprising for instance a central core (or core layer) and at least one decorative top section, directly or indirectly affixed to said core layer, or integrated with said core layer, wherein the top section defines a top surface of the panel. The top section preferably comprises at least one decorative layer affixed, either directly or indirectly, to an upper surface of the core layer. The decorative layer may be a printed layer, and/or may be covered by at least one protective (top) layer covering said decorative layer. The protective layer also makes part of the decorative top section. The presence of a print layer and/or a protective layer could prevent the panel to be damaged by scratching and/or due to environmental factors such as UV/moisture and/or wear and tear. The print layer may be formed by a film onto which a decorative print is applied, wherein the film is affixed onto the substrate layer and/or an intermediate layer, such as a primer layer, situated in between the substrate layer and the decorative layer. The print layer may also be formed by at least one ink layer which is directly applied onto a top surface of the core layer, or onto a primer layer applied onto the substrate layer. The panel may comprise at least one wear layer affixed, either directly or indirectly, to an upper surface of the decorative layer. The wear layer also makes part of the decorative top section. Each panel may comprise at least one lacquer layer affixed, either directly or indirectly, to an upper surface of the decorative layer, preferably to an upper surface of the wear layer.

The lower side (rear side) of the core (layer(s)) may also constitute the lower side (rear side) of the panel as such. However, it is thinkable, and it may even be preferable, that the panel comprises a backing layer, either directly or indirectly, affixed to said lower side of the core. Typically, the backing layer acts as balancing layer in order to stabilize the shape, in particular the flatness, of the panel as such. Moreover, the backing layer typically contributes to the sound dampening properties of the panel as such. As the backing layer is typically a closed layer, the application of the backing layer to the lower side of the core will cover the core grooves at least partially, and preferably entirely. Here, the length of each core groove is preferably smaller than the length of said backing layer. The backing layer may be provided with cut-out portions, wherein at least a part of said cut-out portions overlap with at least one core groove. The at least one backing layer is preferably at least partially made of a flexible material, preferably an elastomer. The thickness of the backing layer typically varies from about 0.1 to 2.5 mm. Non-limiting examples of materials of which the backing layer can be at least partially composed are polyethylene, cork, polyurethane, polyvinylchloride, and ethylene-vinyl acetate. Optionally, the backing layer comprises one or more additives, such as fillers (like chalk), dyes, resins and/or one of more plasticizers. In a particular embodiment, the backing layer is at least partially made of a composite of ground (or shaved) cork particles bound by resin. Instead of cork other tree related products, such as wood, may be used. The thickness of a polyethylene backing layer is for example typically 2 mm or smaller. The backing layer may either be solid or foamed. A foamed backing layer may further improve the sound dampening properties. A solid backing layer may improve the desired balancing effect and stability of the panel.

The panels may comprise a core comprising a rigid closed cell foam plastic material. An additional advantage of using a foam plastic material is that the presence closed cells not only leads to improved rigidity and improved impact resistance, but also to reduced density and lighter weight in comparison with dimensionally similar non-foam plastic material. The rigidity of the base or core layer may further be improved by applying a toughening agent, wherein the base layer of closed cell foam plastic material contains for instance 3% to 9% by weight of the toughening agent. Because the coupling parts are given a specific form, the substantially complementarily formed coupling parts of adjacent panels can be coupled to each other relatively simply, but durably and efficiently.

Foam plastic materials suitable for forming the foam base layer may include polyurethane, polyamide copolymers, polystyrene, polyvinyl chloride (PVC), polypropylene and polyethylene foamed plastics, all of which have good moulding processability. Polyvinyl chloride (PVC) foam materials are especially suitable for forming the foam base layer because they are chemically stable, corrosion resistant, and have excellent flame-retardant properties. Preferably, chlorinated PVC (CPVC) and/or chlorinated polyethylene (CPE) and/or another chlorinated thermoplastic material is/are used to further improve the hardness and rigidity of the base layers, and of the panels as such. The plastic material used in as foam plastic material in the base layer is free of any plasticizer in order to increase the desired rigidity of the base layer, which is, moreover, also favourable from an environmental point of view. Foam plastic materials according to the invention also include foamed plastic composites and foamed composites including plastic materials. The substantially rigid base layer of each panel is at least partially composed of a composite comprising a closed cell foam plastic material and at least one filler. Conventional materials, like HDF and MDF, are weaker than the aforementioned foamed composite, and will easily lead to breakage and/or damaging. The composite of the base layer comprises one or more fillers, wherein at least one filler is selected from the group consisting of: talc, chalk, wood, calcium carbonate, titanium dioxide, calcined clay, porcelain, a(nother) mineral filler, and a(nother) natural filler. The filler may be formed by fibres and/or may be formed by dust-like particles. Here, the expression "dust" is understood as small dust-like particles (powder), like wood dust, cork dust, or non-wood dust, like mineral dust, stone powder, in particular cement. The average particle size of the dust is preferably between 14 and 20 micron, more preferably between 16 and 18 micron. The weight content of this kind of filler in the composite is between 40 and 48% in case the composite is a foamed composite, and preferably between 65 and 70% in case the composite is a non-foamed (solid) composite. The filler of the base layer may for instance be selected from the group consisting of: a salt, a stearate salt, calcium stearate, and zinc stearate. Stearates have the function of a stabilizer, and lead to a more beneficial processing temperature, and counteract decomposition of components of the composite during processing and after processing, which therefore provide long-term stability. Instead of or in addition to a stearate, for example calcium zinc may also be used as stabilizer. The weight content of the stabilizer(s) in the composite will preferably be between 1 and 5%, and more preferably between 1.5 and 4%.

The base layer, or the composite of the base layer preferably comprises at least one impact modifier comprising at least one alkyl methacrylates, wherein said alkyl methacrylate is preferably chosen from the group consisting of: methyl methacrylate, ethyl methacrylate, propyl methacrylate, isopropyl methacrylate, t-butyl methacrylate and isobutyl methacrylate. The impact modifier typically improves the product performance, in particular the impact resistance. Moreover, the impact modifier typically toughens the base layer and can therefore also be seen as toughening agent, which further reduces the risk of breakage. Often, the modifier also facilitates the production process, for example, in order to control the formation of the foam with a relatively consistent (constant) foam structure. The weight content of the impact modifier in the composite will preferably be between 1 and 9%, and more preferably between 3 and 6%.

The base layer may also at least partially be composed of a (PVC-free) thermoplastic composition. This thermoplastic composition may comprise a polymer matrix comprising (a) at least one ionomer and/or at least one acid copolymer; and (b) at least one styrenic thermoplastic polymer, and, optionally, at least one filler. An ionomer is understood as being a copolymer that comprises repeat units of electrically neutral and ionized units. Ionized units of ionomers may be in particular carboxylic acid groups that are partially neutralized with metal cations. Ionic groups, usually present in low amounts (typically less than 15 mol % of constitutional units), cause micro-phase separation of ionic domains from the continuous polymer phase and act as physical crosslinks. The result is an ionically strengthened thermoplastic with enhanced physical properties compared to conventional plastics.

The density of the foam base layer typically varies from about 0.1 to 1.5 g/cm$^3$, preferably from about 0.2 to 1.4 g/cm$^3$, more preferably from about 0.3 to 1.3 g/cm$^3$, even more preferably from about 0.4 to 1.2 grams/cm$^3$, even more preferably from about 0.5 to 1.2 g/cm$^3$, and most preferably from about 0.6 to 1.2 g/cm$^3$.

The base layer may comprise at least one foaming agent. The at least one foaming agent takes care of foaming of the base layer, which will reduce the density of the base layer. This will lead to light weight panels, which are lighter weight in comparison with panels that are dimensionally similar and which have a non-foamed base layer. The preferred foaming agent depends on the (thermo)plastic material used in the base layer, as well as on the desired foam ratio, foam structure, and preferably also the desired (or required) foam temperature to realise the desired foam ratio and/or foam structure. To this end, it may be advantageous to apply a plurality of foaming agents configured to foam the base layer at different temperatures, respectively. This will allow the foamed base layer to be realized in a more gradual, and more controller manner. Examples of two different foaming agents which may be present (simultaneously) in the base layer are azidicarbonamide and sodium bicarbonate. In this respect, it is often also advantageous to apply at least one modifying agent, such as methyl methacrylate (MMA), in order to keep the foam structure relatively consistent throughout the base layer.

Each panel may comprise an upper substrate affixed to an upper side of the base layer, wherein said substrate preferably comprises a decorative layer. The upper substrate is preferably at least partially made of at least one material selected from the group consisting of: metals, alloys, macromolecular materials such as vinyl monomer copolymers and/or homopolymers; condensation polymers such as polyesters, polyamides, polyimides, epoxy resins, phenol-formaldehyde resins, urea formaldehyde resins; natural macromolecular materials or modified derivatives thereof such as plant fibres, animal fibres, mineral fibres, ceramic fibres and carbon fibres. Here, the vinyl monomer copolymers and/or homo-polymers are preferably selected from the group consisting of polyethylene, polyvinyl chloride (PVC), polystyrene, polymethacrylates, polyacrylates, polyacrylamides, ABS, (acrylonitrile-butadiene-styrene) copolymers, polypropylene, ethylene-propylene copolymers, polyvinylidene chloride, polytetrafluoroethylene, polyvinylidene fluoride, hexafluoropropene, and styrene-maleic anhydride copolymers, and derivates thereof. The upper substrate most preferably comprises polyethylene or polyvinyl chloride (PVC). The polyethylene can be low density polyethylene, medium density polyethylene, high density polyethylene or ultra-high density polyethylene. The upper substrate layer can also include filler materials and other additives that improve the physical properties and/or chemical properties and/or the processability of the product. These additives include known toughening agents, plasticizing agents, reinforcing agents, anti-mildew (antiseptic) agents, flame-retardant agents, and the like. The upper substrate typically comprises a decorative layer and an abrasion resistant wear layer covering said decorative layer, wherein a top surface of said wear layer is the top surface of said panel, and wherein the wear layer is a transparent material, such that decorative layer is visible through the transparent wear layer.

The thickness of the upper substrate typically varies from about 0.1 to 2 mm, preferably from about 0.15 to 1.8 mm, more preferably from about 0.2 to 1.5 mm, and most preferably from about 0.3 to 1.5 mm. The thickness ratio of the base layer to the upper substrate commonly varies from about 1 to 15:0.1 to 2, preferably from about 1.5 to 10:0.1 to 1.5, more preferably from about 1.5 to 8:0.2 to 1.5, and most preferably from about 2 to 8:0.3 to 1.5, respectively.

Each panel may comprise an adhesive layer to affix the upper substrate, directly or indirectly, onto the base layer. The adhesive layer can be any well-known bonding agent or binder capable of bonding together the upper substrate and the foam base layer, for example polyurethanes, epoxy resins, polyacrylates, ethylene-vinyl acetate copolymers, ethylene-acrylic acid copolymers, and the like. Preferably, the adhesive layer is a hot-melt bonding agent. The base layer, or core, and upper substrate may also be fused together.

The decorative layer or design layer, which may be part of the upper substrate as mentioned above, can comprise any suitable known plastic material such as a known formulation of PVC resin, stabilizer, plasticizer and other additives that are well known in the art. The design layer can be formed with or printed with printed patterns, such as wood grains, metal or stone design and fibrous patterns or three-dimensional figures. Thus the design layer can provide the panel with a three dimensional appearance that resembles heavier products such as granite, stone or metal. The thickness of the design layer typically varies from about 0.01 to 0.1 mm, preferably from about 0.015 to 0.08 mm, more preferably from about 0.2 to 0.7 mm, and most preferably from about 0.02 to 0.5 mm. The wear layer that typically forms the upper surface of the panel can comprise any suitable known abrasion-resistant material, such as an abrasion-resistant macromolecular material coated onto the layer beneath it, or a known ceramic bead coating. If the wear layer is furnished in layer form, it can be bonded to the layer beneath it. The wear layer can also comprise an organic polymer layer and/or inorganic material layer, such as an ultraviolet coating or a combination of another organic polymer layer and an ultraviolet coating. For example, an ultraviolet paint capable of improving the surface scratch resistance, glossiness, antimicrobial resistance and other properties of the product. Other organic polymers including polyvinyl chloride resins or other polymers such as vinyl resins, and a suitable amount of plasticizing agent and other processing additives can be included, as needed. The decorative layer or design layer may also be digitally printed directly onto the core layer.

The plastic foam used in the base layer preferably has an elastic modulus of more than 700 MPa (at a temperature of 23 degrees Celsius and a relative humidity of 50%). This will commonly provide sufficiently rigidity to the base layer, and hence to the panel as such.

In an embodiment, the coupling parts are arranged to be coupled with a motion which is perpendicular to the plane of the panels. The coupling part may for instance be substantially hook shaped, and be made compared to the third and fourth coupling parts as described for this invention. So, in an embodiment the wall panels may be provided with the third and fourth coupling parts only, instead of the first and second. Preferably the third coupling part comprises an upward tongue, at least one upward flank lying at a distance from the upward tongue and an upward groove formed in between the upward tongue and the upward flank, with an upward bridge connecting the upward tongue to the core, wherein the upward groove is adapted to receive at least a part of a downward tongue of the fourth coupling part of another panel, wherein the side of the upward tongue facing towards the upward flank is the inside of the upward tongue and the side of the upward tongue facing away from the upward flank is the outside of the upward tongue; wherein the fourth coupling part comprises a downward tongue, at least one downward flank lying at a distance from the downward tongue, and a downward groove formed in between the downward tongue and the downward flank, with a downward bridge connecting the downward tongue and the core, wherein the downward groove is adapted to receive at least a part of the upward tongue of the first coupling part of another panel, wherein the side of the downward tongue facing towards the downward flank is the inside of the downward tongue and the side of the downward tongue facing away from the downward flank is the outside of the downward tongue. The insides of the upward and downward tongues may be inclined towards the core, such that a so-called closed groove locking can be achieved. The recess may then be provided in the upward bridge, extending at least partially through this bridge and accessible from the surface side of the upward bridge. Other features disclosed in other embodiments may also relate to this embodiment.

BRIEF DESCRIPTION OF THE DRAWINGS

The invention further relates to a method of installing a wall covering, preferably with wall panels according to any of the preceding claims, comprising the steps of:

a. Providing a first wall panel, with first and second coupling parts at least two opposite sides;
b. Attaching the first wall panel to a supporting surface, leaving a second coupling part of the first wall panel accessible;
c. Providing a second wall panel, with first and second coupling parts at least two opposite sides;
d. Placing a first coupling part of the second wall panel in the second coupling part of the first wall panel;

e. Angling in the second wall panel to be aligned with the first panel, leaving a second coupling part of the second wall panel accessible;

f. Optionally repeating steps c-e with a further panel.

DESCRIPTION OF THE INVENTION

Before the first wall panel is provided, a base wall panel may be provided with only the second coupling part; and/or the final wall panel may be a last wall panel with only the first coupling part. These parts can be used for the extremities of the wall covering, so the sides or the top and bottom, depending on the orientation of the panels. On the edges or the extremes, the panels are typically not attached to further panels, since there is no more room. Only one of the coupling parts is then provided, such that the covering can be flush or aligned with the edges of the wall to be covered.

Figure 1:
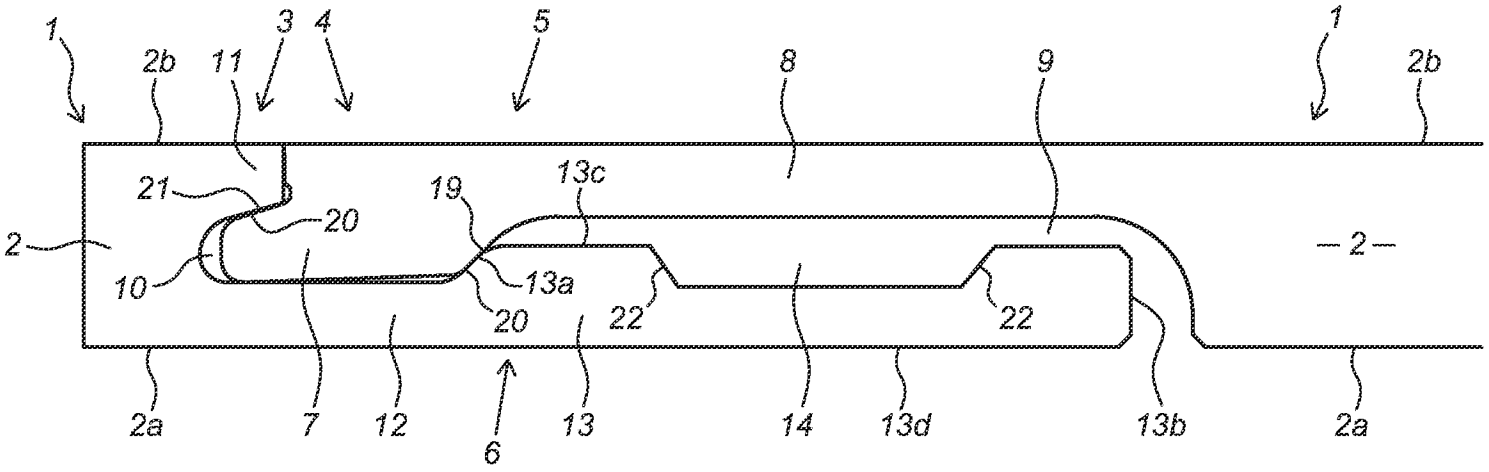

The invention will now be elucidated on the basis of non-limitative exemplary embodiments which are illustrated in the following figures. Corresponding elements are denoted in the figures by corresponding reference numbers. In the figures:

FIG. 1 schematically shows a detail of two wall panels in coupled condition, for forming a wall covering according to the present invention.

Figure 2:
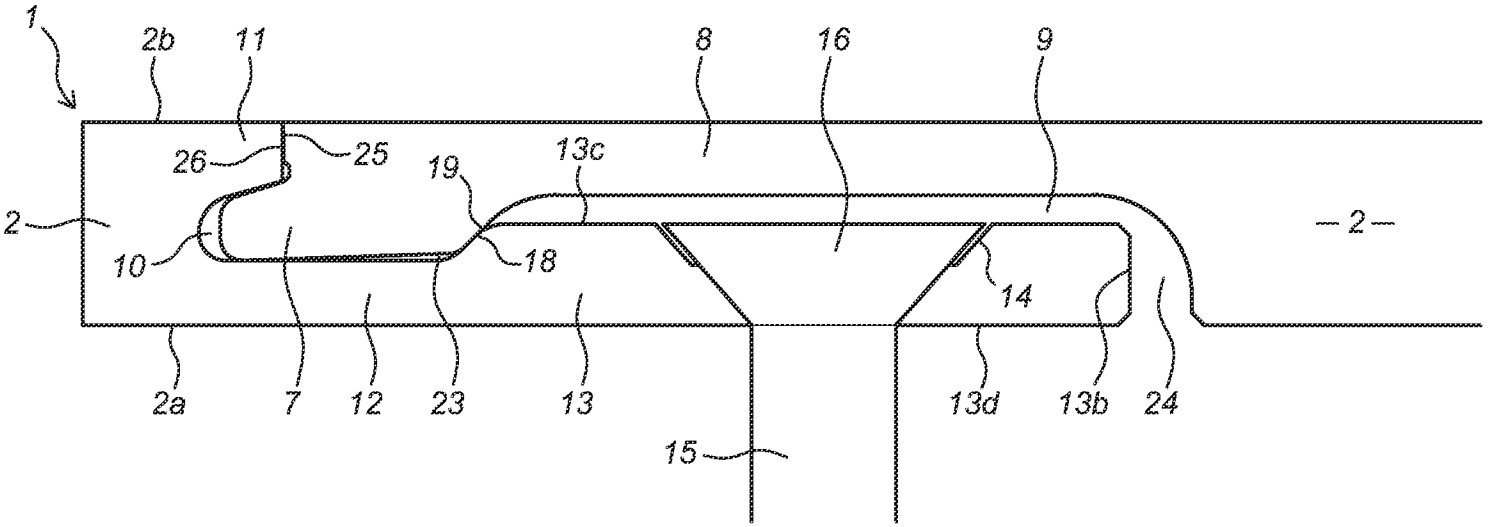
Figure 3:
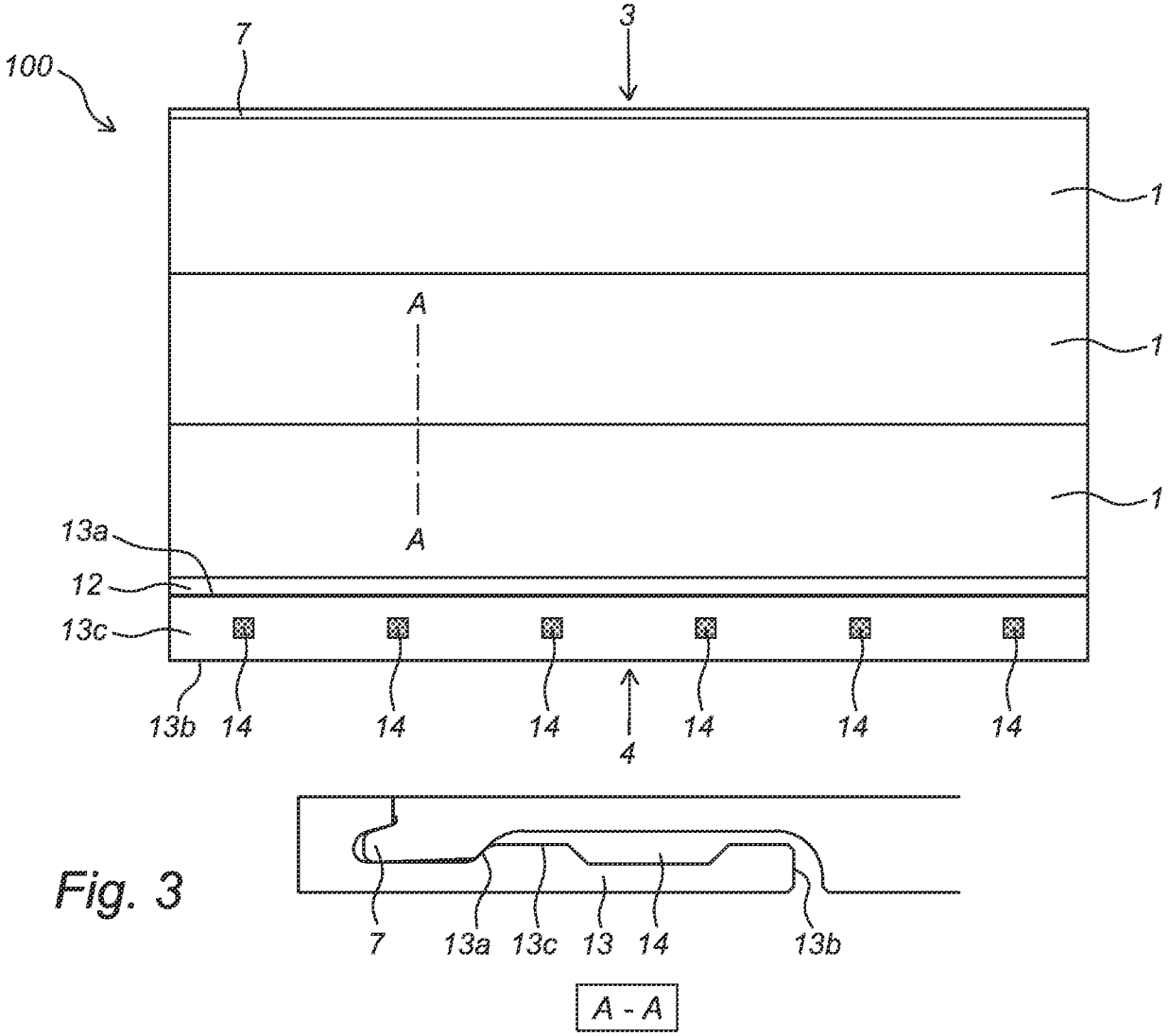
Figure 4:
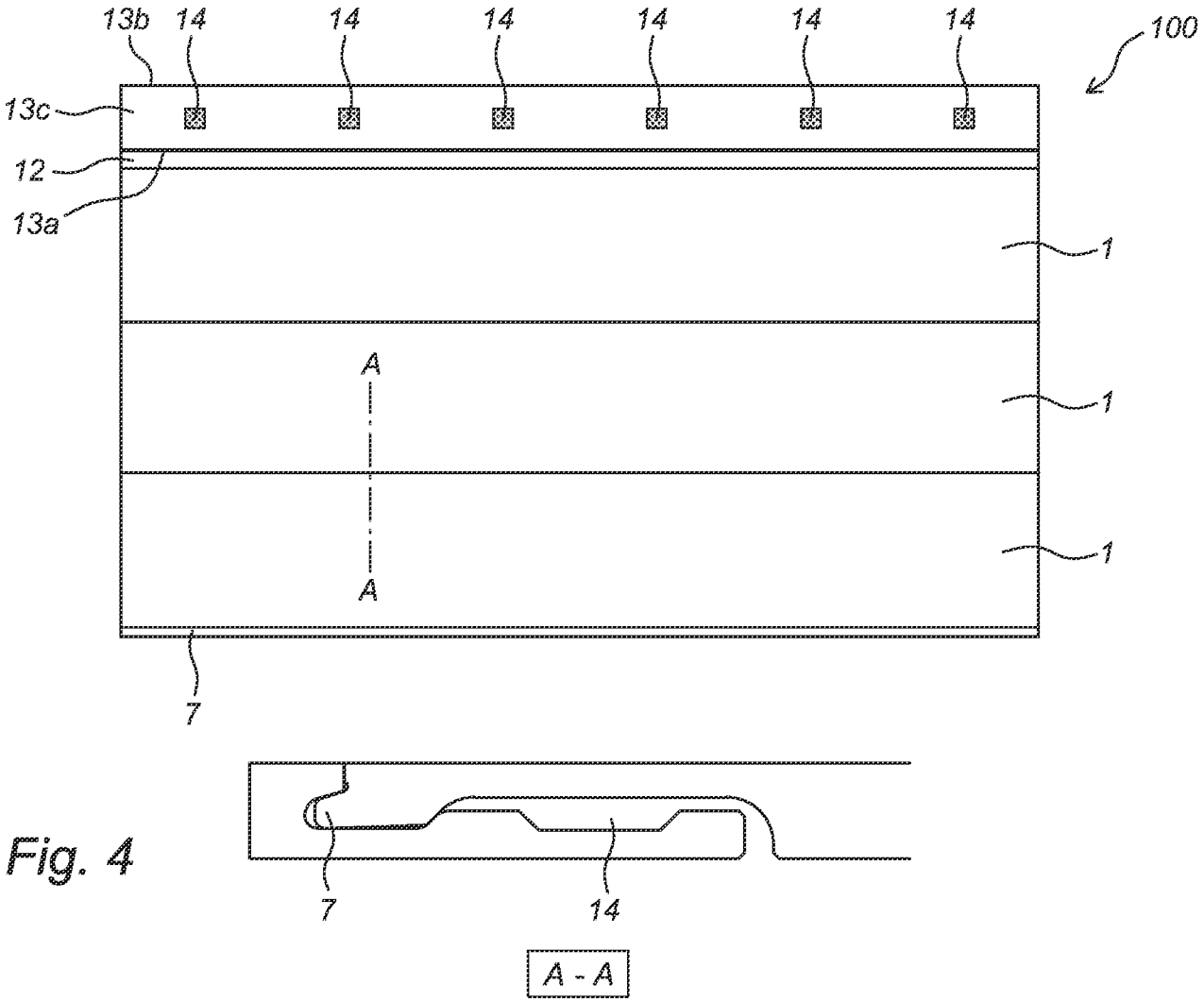
Figure 5:
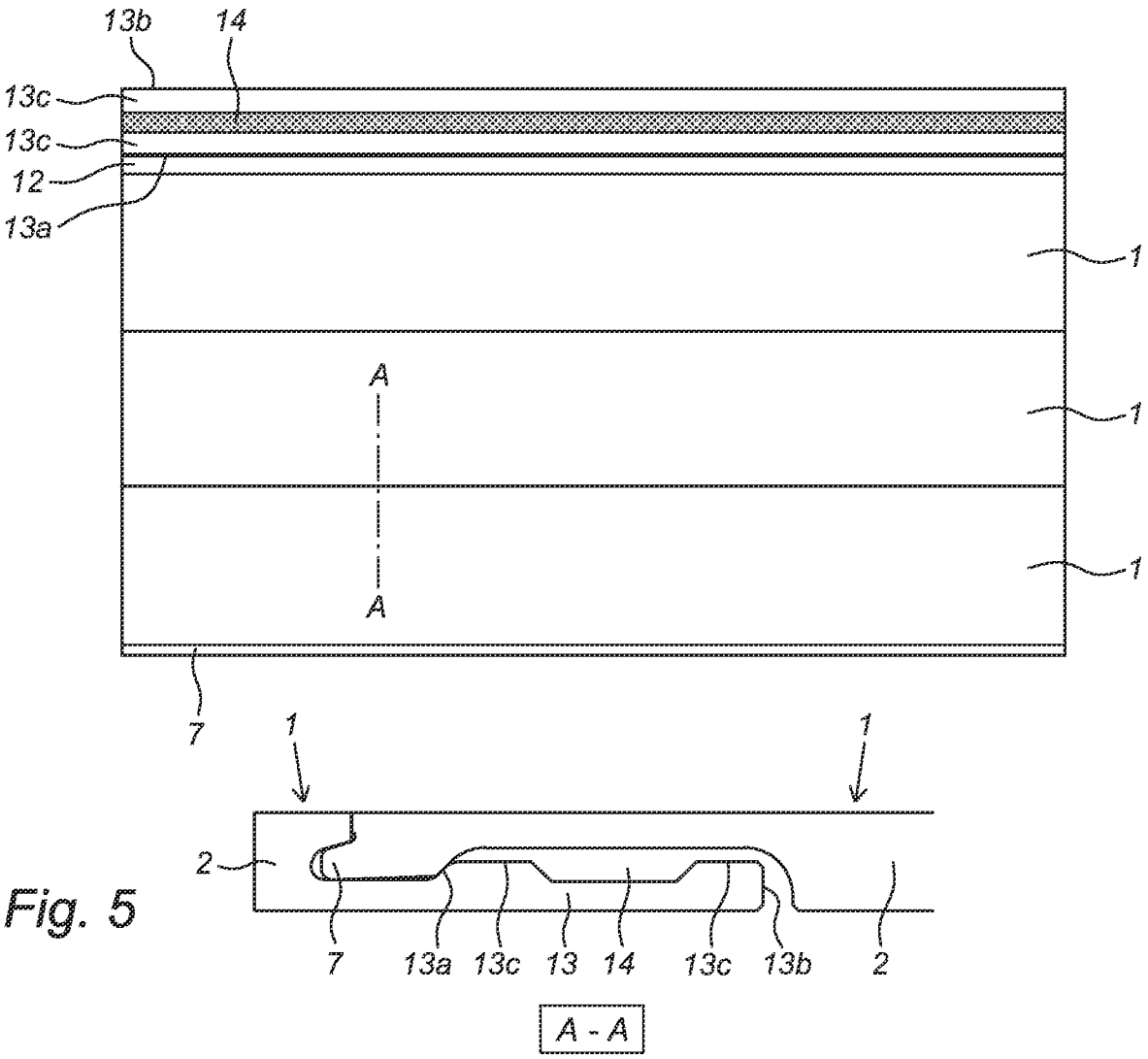
Figure 6:
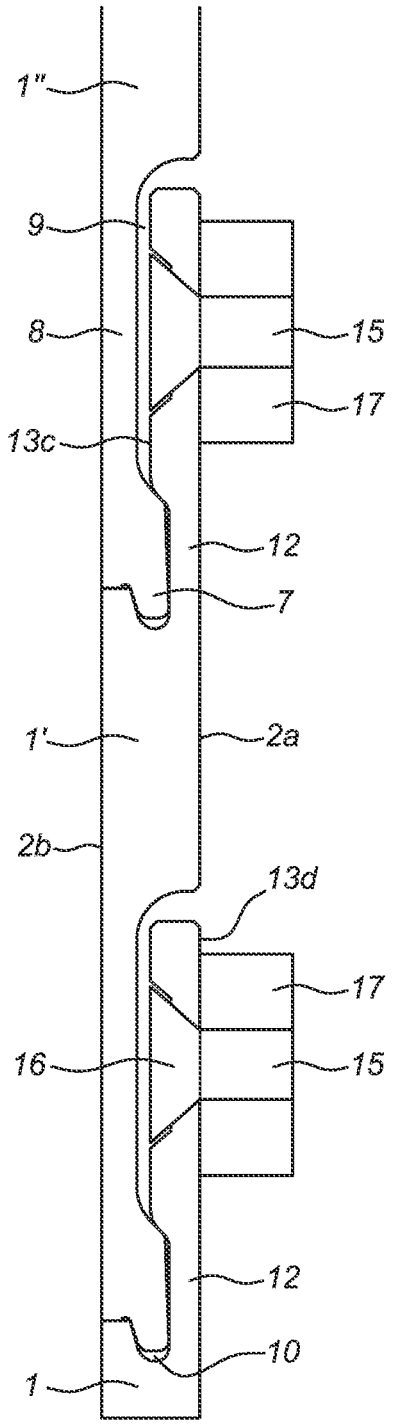
Figure 7:
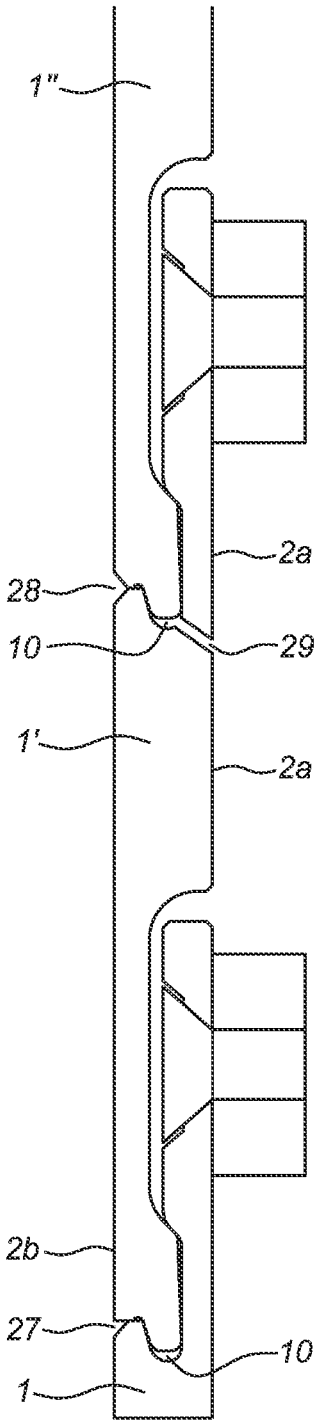
Figure 8:
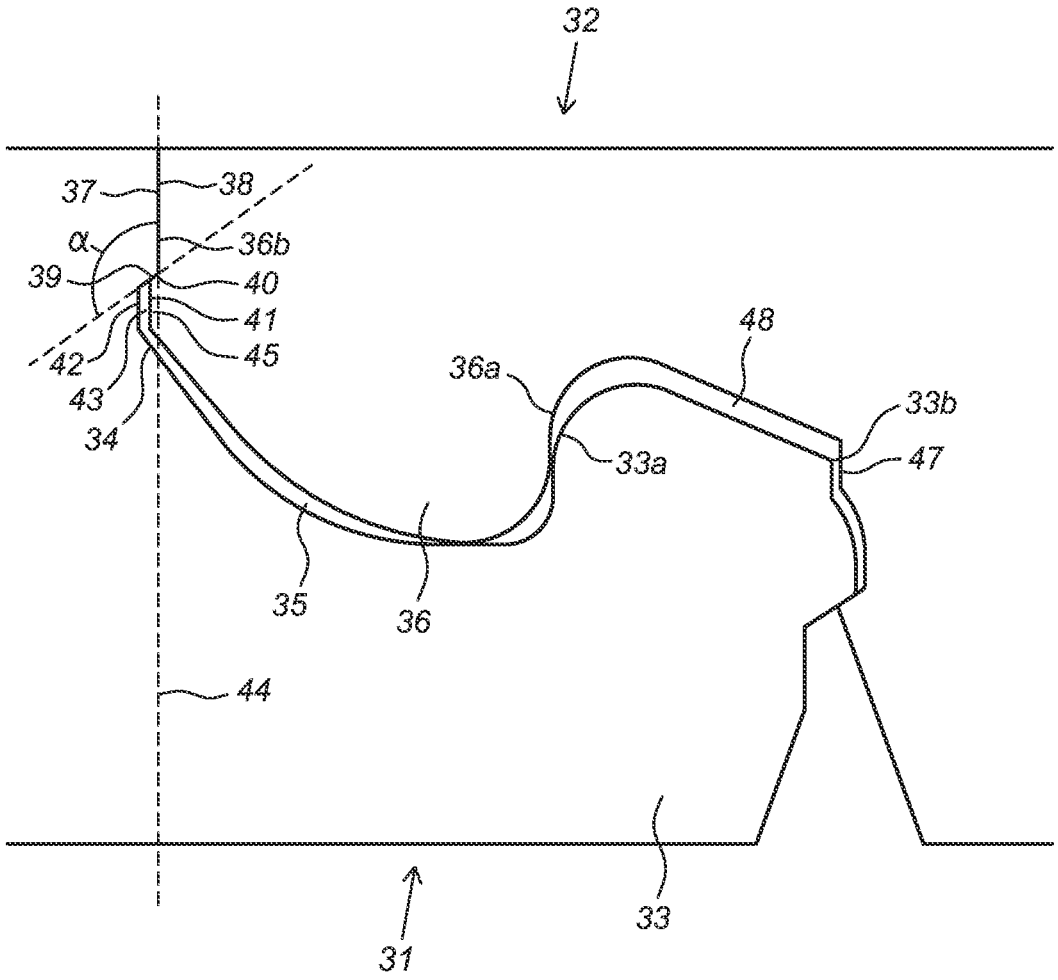
Figure 9:
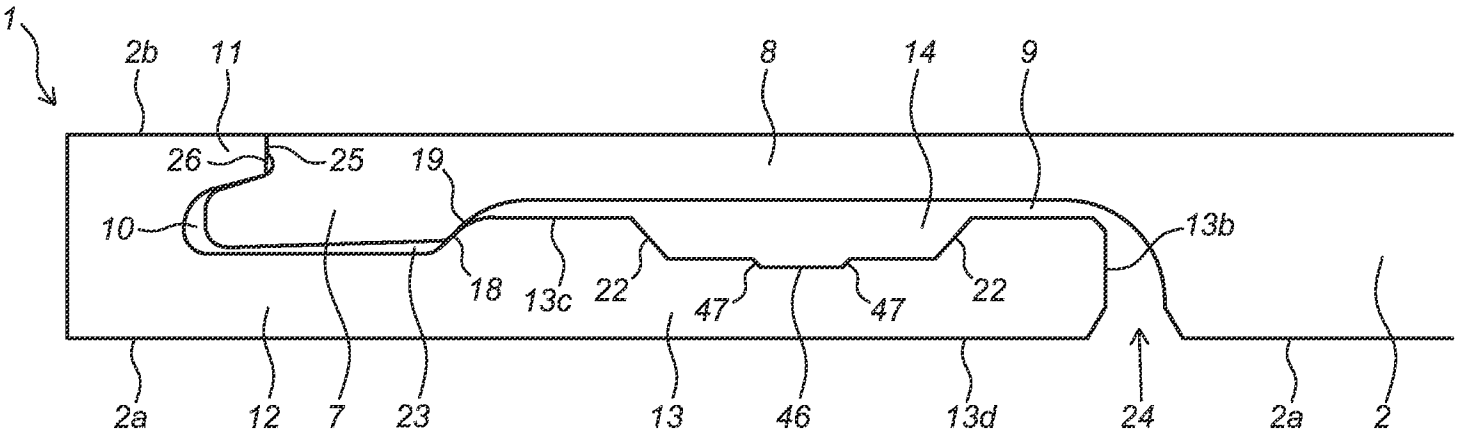

FIG. 2 shows the detail of FIG. 1, with an attachment;

FIG. 3 schematically shows a wall covering, with three wall panels, according to the present invention;

FIG. 4 schematically shows the wall covering of FIG. 3, in an inversed configuration;

FIG. 5 schematically shows a variation on FIG. 4;

FIG. 6 schematically shows a side view on three wall panels forming a wall covering according to the present invention;

FIG. 7 schematically shows variations on the covering of FIG. 6;

FIG. 8 schematically shows an example of the coupling parts on the other sides of the panel; and FIG. 9 schematically shows a variation on FIG. 2.

FIG. 1 schematically shows a detail of two wall panels (1) in coupled condition, for forming a wall covering. Each panel (1) comprises a centrally located core (2), wherein the core comprises a rear side (2*a*), a decorative side (2*b*) opposite the rear side (2*a*), and at least two sides (3, 4) comprising coupling parts for mutual coupling of several panels. FIG. 1 shows the two sides (3, 4) in a coupled condition, in which the sides interact.

The coupling parts comprise at least one first coupling part (5) and at least one second coupling part (6) arranged on opposite sides of the core (2), wherein the first coupling part (5) comprises a sideward tongue (7) and an upper bridge portion (8) for connecting the sideward tongue (7) to the core (2), as well as a downward groove (9). The second coupling part (6) comprises a groove (10), defined by an upper lip (11) and a lower lip extending (12) from the core (2), wherein the lower lip (12) is provided with an upward locking element (13) arranged at a distance from the core (2), which upward locking element (13) has an inside (13*a*) facing the core (2), an outside (13*b*) facing away from the core (2) and a surface side (13*c*) between the inside (13*a*) and the outside (13*b*).

The upward locking element (13) is provided with a recess (14), extending partially through the upward locking element (13), which recess (14) is accessible from the surface side (13*c*) of the upward locking element (13) and extends towards an opposite side (13*d*) of the upward locking element (13). The recess (14) provides for a predetermined location for attaching the wall panel (1) to a supporting surface, such as a beam. For example, a nail, screw or cram can be used to attach the wall panel (1), wherein the nail head or screw head for example falls within the recessed space of the recess (14).

The inside (13*a*) of the upward locking element (13) comprises a first locking surface (18), and the side of the sideward tongue (7) facing towards the core (2) comprises a second locking surface (19), which locking surfaces cooperate to provide locking of the panels in coupled condition. The side of the sideward tongue (7) facing towards the decorative side (2*b*) comprises a third locking surface (20), and the side of the upper lip (11) facing away from the decorative side comprises a fourth locking surface (21), which locking surfaces cooperate to provide locking of the panels in coupled condition.

The recess (14) is provided with bevelled edges (22), with a substantially truncated cone shape in cross section, widest at the decorative side narrowing towards the rear side. The recess (14) is centred in the upward locking element (13), in between the inside (13*a*) and the outside (13*b*) of the upward locking element (13).

FIG. 2 shows the detail of FIG. 1, wherein a screw (15) is shown, with its head (16) arranged at least partially in the recess (14). FIG. 2 also shows that in coupled condition a space (23) is present between the side of the sideward tongue (7) facing the rear side (2*a*), or the bottom of the sideward tongue (7), and the lower lip (12), wherein the space tapers from the upward locking element (13) towards the core (2). The width of upward locking element (13) as shown is less compared to the width of the upper bridge portion (8), such that a space (24) is present between the outside (13*b*) of the upward locking element (13) and the core (2) of another panel in coupled condition, in the shown configuration the panel on the right.

The first coupling part comprises a first upper contact surface (25), between the decorative side (2*b*) and the sideward tongue (7) and the side of the upper lip (11) facing away from the core (2) comprises a second upper contact surface (26), wherein the first and second upper contact surfaces are in contact at least partially.

FIG. 3 schematically shows a wall covering (100), with three wall panels (1). FIG. 3 shows a view onto the decorative side, wherein at the top a sideward tongue (7) portion is shown, not connected to a next panel and at the bottom a lower lip (12) is shown transitioning into the inside (13*a*) of the upward locking element (13) as well as the surface side (13*c*). FIG. 3 shows an embodiment in which six recesses (14) are used, spread over the long side (4) of the panels (1).

FIG. 4 schematically shows the wall covering (100) of FIG. 3, in an inversed configuration, with the sideward tongue (7) at the bottom, and the lower lip (12) at the top.

FIG. 5 schematically shows a variation on FIG. 4. Instead of a number of recesses (14) in the upward locking element (13), the recess (14) is embodied as a continuous groove extending along the length of the panel (1).

FIG. 6 schematically shows a side view on three wall panels (1), of which panels (1) only the middle one is fully shown. In terms of installation, the bottom panel (1) is placed first and secured to a supporting structure (17) by means of a screw (15), connecting the bottom panel (1) to the supporting structure (17). Next the middle panel (1') is angled into the bottom panel (1) by placing the sideward tongue (7) into the groove (10) and angling the tongue (7) into the groove (10). When the middle panel (1') is aligned or in the same plane as the bottom panel (1), the middle panel (1') is also secured to a supporting structure (17) by means of a screw (15). Now the groove (10) of the middle panel (1') is available to accept the sideward tongue (7) of the top panel (1") and the process can continue until the required height is reached. The same process can be applies, but turned 90 degrees, if the panels are placed vertically, instead of horizontally.

FIG. 7 shows a variation on the covering of FIG. 6. The variations can be applied to any panel in any configuration, and are not limited to the embodiment as shown, the principles are applicable wider. At the bottom connection between the lower panel (1) and the middle panel (1') a first bevel (27) is shown. This bevel (27) is formed by a chamfering at the decorative surface (2*b*) of the first panel (1), while no chamfering is present at the second panel (1'). Liquid collecting on the decorative surface (2*b*), dripping down from the middle panel (1') to the bottom panel (1) is thus prevented from seeping through the connection, but instead is guided towards the outside of the bottom panel (1).

At the middle connection between the middle panel (1') and the top panel (1") a second bevel (28) is shown. This bevel (28) is formed by a chamfering at the decorative surface (2*b*) of the middle panel (1') and the top panel (1"). Such bevel (28) has a similar purpose, but has a different appearance.

At the middle connection the groove (10) of the middle panel (1') comprises a channel (29), extending from the groove (10) to the rear side (2*a*) of the wall panel to pass potential liquid collecting in the groove (10) to the rear side (2*a*).

FIG. 8 schematically shows the coupling parts on the other sides of the panel, if such coupling parts are present. In the description references is made to the vertical and horizontal, which holds for the orientation the coupling parts are shown in FIG. 8. On wall panelling, the orientation may be flipped or reversed, wherein the same changes are to be applied to the terms used.

These coupling parts, as shown in FIG. 8, may be third (31) and fourth (32) coupling parts which are arranged to be coupled by means of a downward motion The third coupling part (31) comprises an upward tongue (33), at least one upward flank (34) lying at a distance from the upward tongue and an upward groove (35) formed in between the upward tongue and the upward flank, wherein the upward groove is adapted to receive at least a part of a downward tongue of the fourth coupling part of another panel. The side (33*a*) of the upward tongue (33) facing towards the upward flank (35) is the inside of the upward tongue and the side (33*b*) of the upward tongue facing away from the upward flank is the outside of the upward tongue.

The fourth coupling part (32) comprises a downward tongue (36), at least one downward flank lying (47) at a distance from the downward tongue, and a downward groove (48) formed in between the downward tongue and the downward flank, wherein the downward groove is adapted to receive at least a part of the upward tongue of the first coupling part of another panel. The side (36*a*) of the downward tongue facing towards the downward flank is the inside of the downward tongue and the side (36*b*) of the downward tongue facing away from the downward flank is the outside of the downward tongue. The outside of the downward tongue and the upward flank both comprise an upper contact surface (37, 38) near, or at, or adjoining, or towards a top side of the panel, wherein said contact surfaces extend vertically at least partly, and preferably completely, and wherein the upper contact surface of the outside of the downward tongue of said panel is configured to engage the upper contact surface of the upward flank of an adjacent panel, in coupled condition of said panels.

Adjoining the upper contact surfaces (37, 38) both the downward tongue and the upward flank comprise an inclined contact surface (39, 40), wherein the inclined contact surface of the downward tongue of said panel is configured to engage the inclined contact surface of the upward flank of an adjacent panel, in coupled condition of said panels, wherein each vertical part of the upper contact surface and each adjoining inclining surface mutually enclose an angle (a) between 100 and 175 degrees. Adjoining the inclined contact surface (40) the downward tongue comprises an outer surface (41), situated below the inclined contact surface of the downward tongue, and adjoining the inclined contact surface (39) the upward flank comprises an inner surface (42), situated below the inclined contact surface of the upward flank, wherein the outer and inner surface run substantially parallel and extend at least partly in vertical direction. In coupled condition a space (43) is present between at least a part of the outer surface of said panel and at least a part the inner surface of an adjacent panel.

The upper contact surfaces (37, 38) may define a plane, in this shown configuration a vertical plane (44), wherein a portion (45) of the downward tongue (36) may thus protrude from this plane (44)

FIG. 9 schematically shows a variation on the coupling parts as shown in FIGS. 1-7. Reference signs indicating the same or similar features have the same reference numbers. Compared to the parts as shown in FIGS. 1-7 the recess (14) is provided with a second recess (46). The depth is this recess may be significantly less compared to the depth of the recess (14), and may be provided with similarly chamfered sides (47). The second recess (47) is shown in the centre of the recess (14). This second recess (47) may be incorporated in any of the embodiments shown in FIGS. 1-7, and aims to guide a connecting element like a nail or screw used to connect or attach the panels to a surface.

FIG. 9 also schematically shows the space (23) between the rear of the sideward tongue (7) and the lower lip (12), which is present between the locking surfaces (18, 19) and the outside or outermost side of the sideward tongue (7), wherein the rear side of the sideward tongue (7) and the lower lip (12) are thus not in contact with each other in coupled condition.

The above-described inventive concepts are illustrated by several illustrative embodiments. It is conceivable that individual inventive concepts may be applied without, in so doing, also applying other details of the described example. It is not necessary to elaborate on examples of all conceivable combinations of the above-described inventive concepts, as a person skilled in the art will understand numerous inventive concepts can be (re)combined in order to arrive at a specific application.

It will be apparent that the invention is not limited to the working examples shown and described herein, but that numerous variants are possible within the scope of the attached claims that will be obvious to a person skilled in the art.

The verb "comprise" and conjugations thereof used in this patent publication are understood to mean not only "comprise", but are also understood to mean the phrases "contain", "substantially consist of", "formed by" and conjugations thereof.

The invention claimed is:

1. A panel for forming a covering with multiple panels, comprising:

a. a core with an upper side and a lower side, wherein said core comprises at least two sides of coupling parts for mutual coupling of the multiple panels, and a decorative top structure affixed, either directly or indirectly, onto said upper side of the core;

b. wherein the coupling parts comprise at least one first coupling part and at least one second coupling part arranged on opposite sides of the core, wherein the at least one first coupling part and the at least one second coupling part are arranged to be coupled with an angling motion;

c. wherein the at least one first coupling part comprises a sideward tongue, an upper bridge portion for connecting the sideward tongue to the core and a downward groove, for accommodating at least a part of an upward locking element;

d. wherein the at least one second coupling part comprises a horizontally-extending groove, for accommodating at least a part of the sideward tongue, defined by an upper lip and a lower lip extending from the core, wherein an end portion of the lower lip is provided with the upward locking element, which the upward locking element has an inside facing the upper lip, an outside facing away from the upper lip, and an upper side between the inside and the outside;

e. wherein the inside of the upward locking element comprises a first locking surface, and a side of the sideward tongue facing towards the core comprises a second locking surface, which locking surfaces cooperate to provide locking of the panels in coupled condition;

f. wherein a distal end of the upper lip defines a joint vertical plane, wherein the lower lip extends beyond said joint vertical plane, and wherein the upper lip and the first locking surface are situated at opposite sides of said joint vertical plane; and g. wherein said upper side of the upward locking element is provided with at least one recess, extending at least partially through the upward locking element for receiving at least one fastening element for fastening the panel onto a support structure.

2. The panel according to claim 1, wherein the at least one recess is provided with bevelled edges, wherein the at least one recess has a substantially truncated cone shape in cross section, widest at the upper side of the core decorative top structure narrowing towards the lower side of the core.

3. The panel according to claim 1, wherein the at least one recess extends maximally halfway the upward locking element.

4. The panel according to claim 1, wherein in coupled condition a space is present between a lower side of the sideward tongue and the lower lip, wherein the space tapers from the upward locking element inwards.

5. The panel according to claim 1, wherein the at least one first coupling part, the at least one second coupling part, or the at least one first and second coupling parts comprises a bevel or grout, arranged at the decorative top structure of the panel.

6. The panel according to claim 1, wherein the downward groove comprises a channel, extending from the downward groove to the bottom side of the panel.

7. The panel according to claim 1, wherein two other opposing sides of the panel are provided with third and fourth coupling parts, arranged to be coupled in the same angling motion as the at least one first and second coupling parts.

8. The panel according to claim 1, wherein the panel is elongated, wherein the at least one first and second coupling parts are arranged on a long side of the panel and wherein two other opposing sides of the panel are not provided with the coupling parts.

9. The panel according to claim 1, wherein the panel is elongated, wherein the at least one first and second coupling parts are arranged on a long side of the panel and wherein along the long side of the panel multiple recesses are present evenly spaced along the long side.

10. The panel according to claim 1, wherein the at least one recess in the upward locking element forms a recessed groove, extending along a long side of an elongated panel.

11. The panel according to claim 1, wherein a thickness of the upward locking element is about half a thickness of the panel.

12. The panel according to claim 1, wherein a bottom section of the downward groove is positioned at both sides of the joint vertical plane virtually dividing the bottom section into an inner bottom section and an outer bottom section, wherein the bottom section has a width perpendicular to the joint vertical plane, and wherein a width of the outer bottom section (W-OBS) exceeds a width of the inner bottom section (W-IBS), and wherein a width of upward locking element is larger than the width of the bottom section (W−OBS+W−IBS).

13. The panel according to claim 1, wherein a bottom section of the downward groove is positioned at both sides of the joint vertical plane virtually dividing the bottom section into an inner bottom section and an outer bottom section, wherein the bottom section has a width perpendicular to the joint vertical plane, and wherein a width of the outer bottom section (W-OBS) exceeds a width of the inner bottom section (W-IBS), wherein a width of the recess in the upward locking element is larger than the width of the bottom section of the groove (W−OBS+W−IBS).

14. The panel according to claim 1, wherein, in coupled condition of two panels, a space is present between an upper bridge portion of a first panel and the upward locking element of a second panel, at least over a complete width of the upward locking element, wherein the space continues between a distal end of the upward locking element of the second panel and the core of the first panel.

15. The panel according to claim 1, wherein the panel is a wall panel or ceiling panel.

* * * * *